US010427178B2

(12) United States Patent
Simpson et al.

(10) Patent No.: US 10,427,178 B2
(45) Date of Patent: Oct. 1, 2019

(54) PRESSURISED LIQUID DELIVERY SYSTEM

(71) Applicant: Cyclonas Pty Limited, New South Wales (AU)

(72) Inventors: Andrew Simpson, New South Wales (AU); Marjan Mikel, New South Wales (AU); Wayne Hollow, New South Wales (AU); Stephen Newton, New South Wales (AU); Joshua Mikel, New South Wales (AU); Tyson Rose, New South Wales (AU); Alfred Ching, New South Wales (AU); Steven Burgess, New South Wales (AU)

(73) Assignee: Cyclonas Pty Limited, New South Wales (AU)

( * ) Notice: Subject to any disclaimer, the term of this patent is extended or adjusted under 35 U.S.C. 154(b) by 0 days.

(21) Appl. No.: 15/539,093

(22) PCT Filed: Dec. 14, 2015

(86) PCT No.: PCT/AU2015/000761
§ 371 (c)(1),
(2) Date: Jun. 22, 2017

(87) PCT Pub. No.: WO2016/101011
PCT Pub. Date: Jun. 30, 2016

(65) Prior Publication Data

US 2018/0008994 A1 Jan. 11, 2018

(30) Foreign Application Priority Data

Dec. 22, 2014 (AU) ..... 2014905191
Aug. 18, 2015 (AU) ..... 2015903336

(51) Int. Cl.
*B05B 7/00* (2006.01)
*B05B 7/24* (2006.01)
(Continued)

(52) U.S. Cl.
CPC ..... *B05B 7/241* (2013.01); *B05B 7/0025* (2013.01); *B05B 7/2475* (2013.01); *B65D 83/62* (2013.01);
(Continued)

(58) Field of Classification Search
CPC ..... B05B 7/241; B05B 7/0025; B05B 7/2475; B05B 9/007; B05B 9/0811; B05B 9/0816;
(Continued)

(56) References Cited

U.S. PATENT DOCUMENTS 4,337,769 A * 7/1982 Olson ..... A61M 39/22 128/DIG. 12
4,484,697 A * 11/1984 Fry, Jr. ..... B67D 1/0007 222/1
(Continued)

FOREIGN PATENT DOCUMENTS

CN 101827779 A 9/2010
CN 103189304 A 7/2013
CN 103889882 A 6/2014

*Primary Examiner* — Frederick C Nicolas
(74) *Attorney, Agent, or Firm* — Lee & Hayes, P.C.

(57) ABSTRACT

A pressurized liquid delivery assembly has at least one liquid delivery module. Each module may include a housing and an associated compartment. The compartment may be located within the housing and may be moveable with respect to the housing to permit access to the compartment by a user. The compartment may define a space adapted to receive a replaceable pressurised receptacle containing liquid to be dispensed by the assembly. A liquid dispenser may be operatively associated with the receptacle and adapted to dispense liquid. The dispenser may include a conduit that may be extendable from a dispensing nozzle to a liquid receiving connector. The liquid receiving connector may be adapted to releasably connect to the liquid receptacle in use.

20 Claims, 35 Drawing Sheets

(51) Int. Cl.

| | |
|---|---|
| ***B65D 83/62*** | (2006.01) |
| ***B67D 1/00*** | (2006.01) |
| ***B67D 1/04*** | (2006.01) |
| ***B67D 1/12*** | (2006.01) |
| *B05B 9/00* | (2006.01) |
| *B05B 9/08* | (2006.01) |
| *B67D 1/08* | (2006.01) |

(52) U.S. Cl.
CPC ..... *B67D 1/0001* (2013.01); *B67D 1/04* (2013.01); *B67D 1/1275* (2013.01); *B05B 9/007* (2013.01); *B05B 9/0811* (2013.01); *B05B 9/0816* (2013.01); *B05B 9/0838* (2013.01); *B67D 2001/0821* (2013.01); *B67D 2210/00034* (2013.01); *B67D 2210/00131* (2013.01); *B67D 2210/00163* (2013.01)

(58) Field of Classification Search
CPC .... B05B 9/0838; B65D 83/62; B67D 1/0001; B67D 1/04; B67D 1/1275; B67D 2001/0821; B67D 2210/00034; B67D 2210/00131; B67D 2210/00163
See application file for complete search history.

(56) References Cited

U.S. PATENT DOCUMENTS

| | | | | | |
|---|---|---|---|---|---|
| 4,796,788 | A * | 1/1989 | Bond | B65D 77/067 | 222/105 |
| 4,869,402 | A * | 9/1989 | Ash, Jr. | B67D 1/045 | 222/209 |
| 5,553,749 | A * | 9/1996 | Oyler | B67D 1/00 | 222/129.1 |
| 5,772,075 | A * | 6/1998 | Ash, Jr. | B67D 1/04 | 222/1 |
| 6,186,361 | B1 * | 2/2001 | Teetsel, III | B67B 7/26 | 222/1 |
| 7,086,566 | B2 * | 8/2006 | Goepfert | B67D 1/0007 | 222/135 |
| 7,360,670 | B2 * | 4/2008 | Goepfert | B67D 1/0007 | 222/135 |
| 2004/0065693 | A1 * | 4/2004 | Drennow | B67D 1/0001 | 222/401 |

* cited by examiner

PRESSURISED LIQUID DELIVERY SYSTEM

RELATED APPLICATIONS

This application is a US National Stage of PCT/AU2015-000761, filed on Dec. 22, 2015, which claims the benefit of Australian Provisional Application No. 2014905191, filed on Dec. 22, 2014, and Australian Provisional Application No. 2015903336, filed on Aug. 18, 2015, all of which are incorporated by reference herein in their entirety.

FIELD OF INVENTION

The present invention relates to pressure assemblies and in particular to compression assemblies utilizing air or the like to drive domestic, commercial or industrial applications. The invention relates to the application of air or other pressure for the improvement of current devices typically used in domestic, commercial or industrial settings.

The present invention in a preferred embodiment of the above applications relates to a liquid delivery system and in particular to a liquid delivery system using pressure assemblies to drive liquids through conduits. In particular, the use of an anaerobic system or a vacuum system.

BACKGROUND OF THE INVENTION

Currently there are two ways liquids are delivered in domestic or commercial settings: Either by a manual, mechanical process (eg: pouring a bottle of milk) which is labor and time intensive and creates large amounts of product waste; or automatic liquid pumping (eg: soda syrup post mix) which requires complex and costly moving parts (often electrical) and needs time consuming cleaning processes to be regularly undertaken in order to remain sanitary. In addition, there are instances where having the liquid come in contact with external environmental elements such as air is undesirable (eg: milk spoiling) or even dangerous (eg: fuel vapors being highly flammable).

At the same time, the primary power source of kitchen appliances (for example) is electric motors which have some of the following limitations. They cannot safely get wet, even though many of them operate with liquids in or around them and require individual and complex electric motors for each device which increases the size and cost of the device. In addition to this, without the presence of air in the device, functionality is limited to mechanical movements such as rotation, pushing and pulling only and is incapable of many known and unknown preparation opportunities.

Accordingly, there is a need for a liquid delivery system that is anaerobic (vacuum), easy to clean, modular, has a simple and cheap installation, has little or no maintenance, provides easy loading/unloading of liquid bags or the like (if desired), provides disposable tubing to provide a sanitary device and can easily be modified where needed to suit particular applications.

OBJECT OF THE INVENTION

It is an object of the present invention to substantially overcome or at least ameliorate one or more of the disadvantages of the prior art, or to at least provide a useful alternative.

SUMMARY OF THE INVENTION

There is disclosed herein a pressurised liquid delivery assembly having:

- at least one liquid delivery module, each said module including:
  - a housing and an associated compartment, said compartment locatable within said housing and moveable with respect to said housing to permit access by a user to said compartment;
  - said compartment defining a space adapted in use to receive a replaceable pressurised receptacle containing liquid to be dispensed by said assembly;
  - a liquid dispenser operatively associated with said receptacle and adapted to dispense liquid;
  - said dispenser including a conduit extendable from a dispensing nozzle to a liquid receiving connector, said liquid receiving connector adapted to releasably connect to said liquid receptacle in use.

Preferably, said compartment is a drawer, said drawer being slidably locatable within said housing.

Preferably, the drawer includes a removable cartridge adapted in use to hold a receptacle.

Preferably, said housing is generally rectangular in shape.

Preferably, said compartment in an open position provides access to said space to receive said receptacle.

Preferably, said compartment in a closed position sealingly engages said compartment with said housing.

Preferably, said receptacle is a pressurised liquid bag.

Preferably, said dispenser includes a handle extending from said nozzle.

Preferably, in use said bag is placed in a vacuum.

Preferably, said liquid is driven through said conduit towards said nozzle by way of an anaerobic state of said bag.

Preferably, said assembly includes one or more said modules operatively associated with each other and one or more said nozzles.

Preferably, said one or more modules are connectable together.

Preferably, said handle includes a stop to prevent liquid from flowing through said conduit.

Preferably, said conduit is disposable.

Preferably, said housing and compartment can be press moulded.

Preferably, said assembly can be locatable within a back pack or other transportation device.

Preferably, one or more bags can be loaded within said compartment, said assembly including a connection to connect two or more bags to one or more said nozzle(s).

Preferably, said assembly includes a frother to froth said liquid prior to delivery to said nozzle.

Preferably, said assembly includes an agitator adapted to agitate a liquid delivered from said bag.

Preferably, said assembly includes a piercer adapted in use to pierce said bag to permit liquid located within said bag to flow to said nozzle.

Preferably, the liquid is a beverage or a paint.

BRIEF DESCRIPTION OF DRAWINGS

A preferred embodiment of each invention will now be described, by way of example only, with reference to the accompanying drawings, wherein.

BACKGROUND AND DETAILED DESCRIPTION

Figure 1:
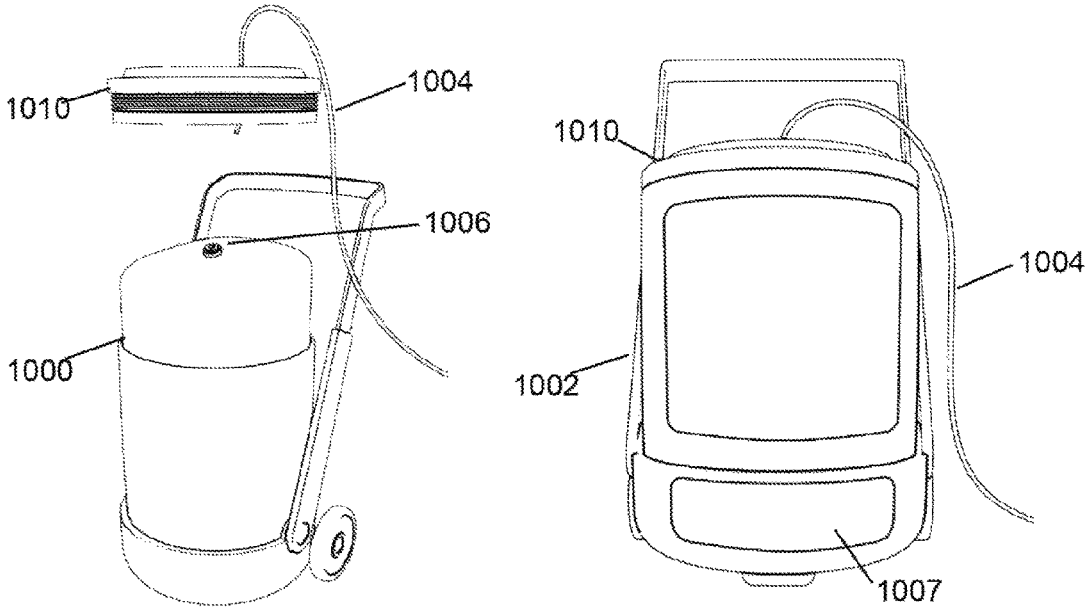
FIGS. 1 and 2 show a pneumatic liquid delivery system of an embodiment of the present invention.
Figure 2:
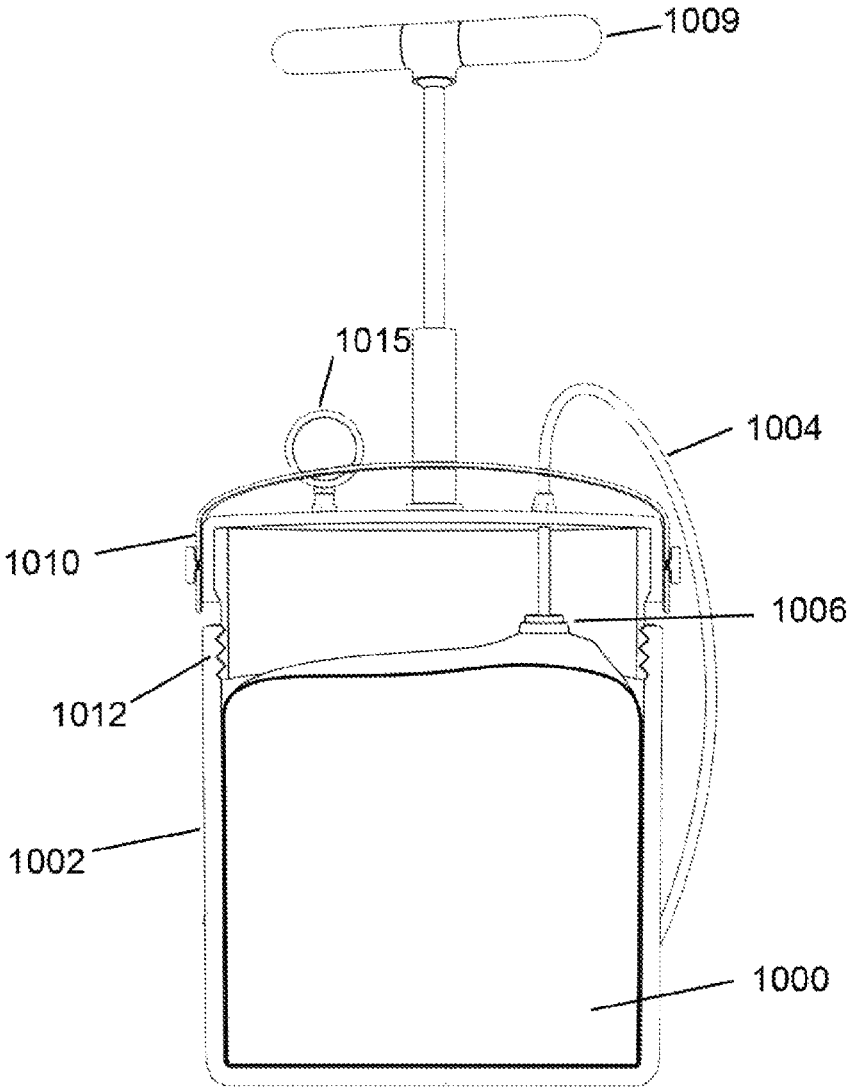

There is disclosed in FIGS. 1 and 2, a bladder 1000 containing liquid (eg: paint in FIG. 1, milk in FIG. 2, fuel, or the like) contained in a sealed structure 1002 (eg: a paint tin in FIG. 1, milk fridge in FIG. 2, a fuel tank, or the like) and pressurized with air coming in through a tube, inlet valve supplied by either an electric compressor 1007, by a manual pressure pump 1009 or some other like means. The bladder 1000 is connected to an outlet valve 1006 and hose 1004 with no (or minimal) mechanical parts and the contained liquid is syphoned out due to a pressure equalization effect. The delivery of liquid is controlled by a faucet or other trigger (not shown) at the end of the outlet valve 1006 and/or hose 1004. The structure 1002 can have a lid 1010 that can be threadingly fastened 1012 with the structure 1002. A pressure gauge 1015 can also be utilised.

Currently, household faucets (eg: kitchen, laundry, bathroom, etc. . . . ) are limited in their effectiveness by the level of water pressure available in the "mains" (i.e. the plumbing of the water). Because they are less effective, they often require more water and time to complete a task (eg: cleaning, filling, washing, etc. . . . ). Also, due to their low amount of output pressure they lack the ability to be used for other purposes (eg: driving mechanical motors, etc.).

Figure 3:
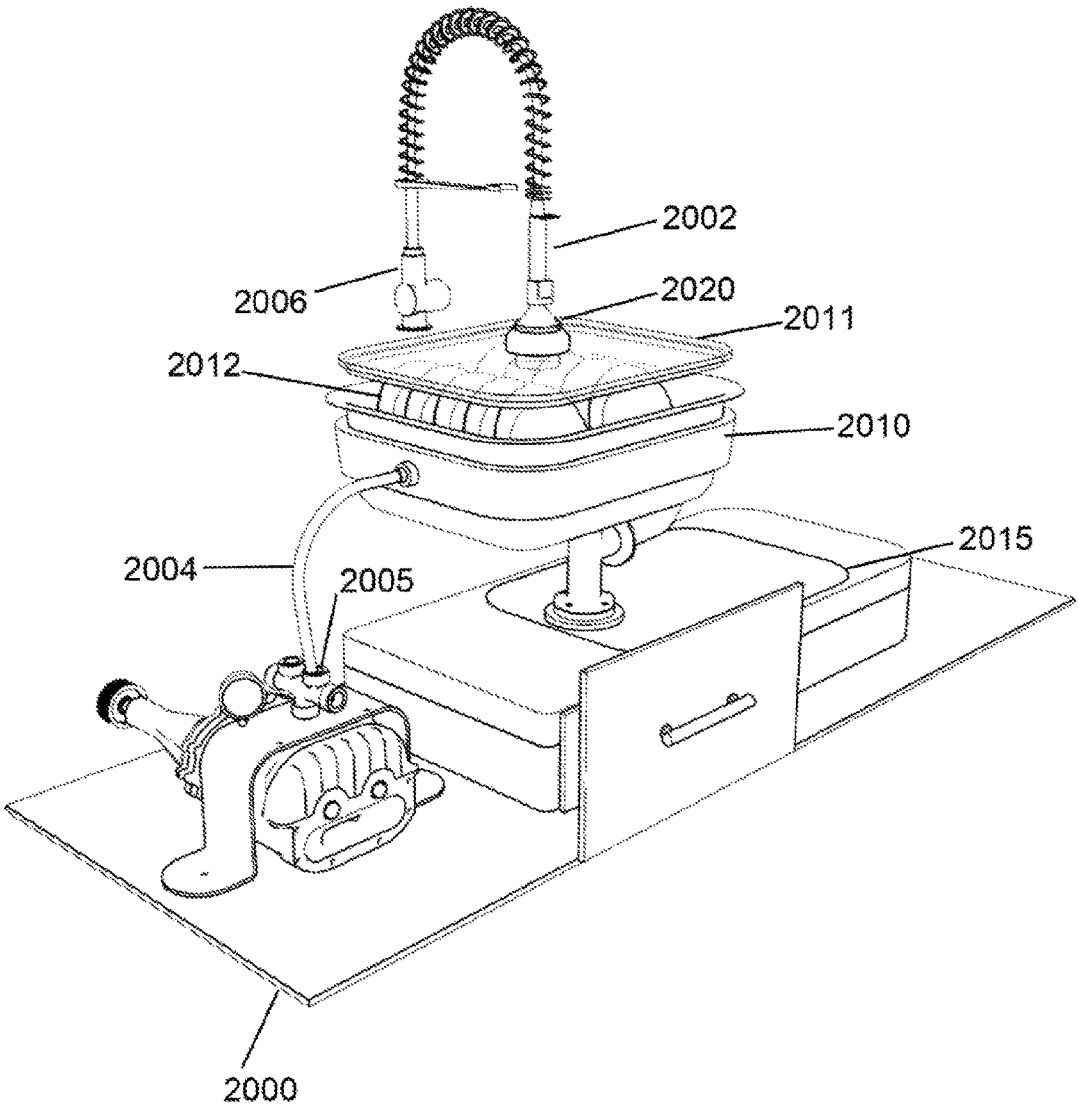
FIGS. 3, 4 and 5 show improvements to household faucets using air pressure.
Figure 4:
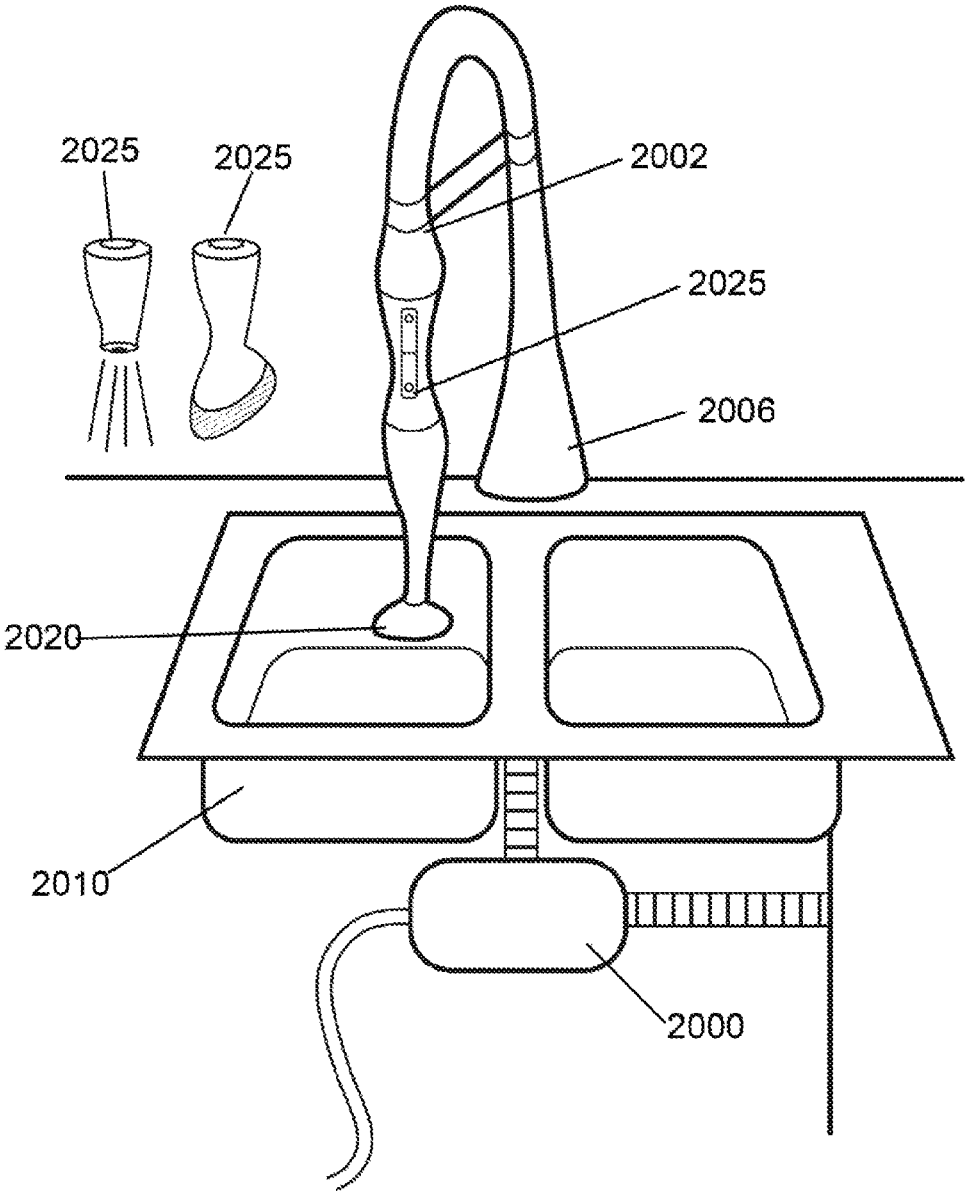
Figure 5:
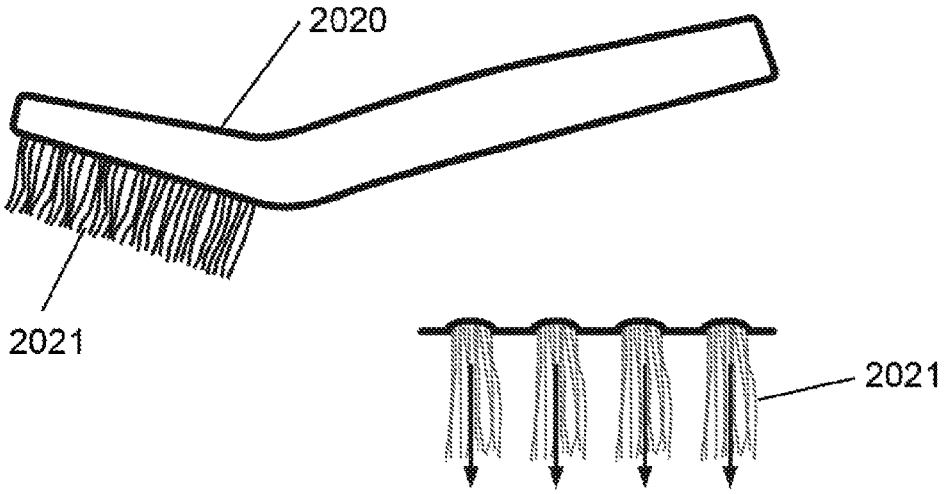

In the embodiment of FIGS. 3 to 5, a high pressure source (eg: air tank or electric pump 2000) is connected to the faucet 2002 via a hose 2004 and other air tight connections 2005. Combined with the existing water supply 2006, the output from the faucet 2002 is now capable of high pressure water and/or air which can be used to increase the performance of the traditional applications of the faucet 2002, including but not limited to high pressure, in sink 2010 dishwashing with increased functionality including but not limited to a sealed, splash protective cover 2011, an air knife is created by the air coming from the compressor which can be used to remove solids from the dishes 2012. A garbage disposal 2015 or the like for the proper disposal of the scraps could also be utilised and functional cleaning head attachments 2020 could be used to change uses of the device. The heads could include bristles 2021 or the like as shown in FIG. 5. In addition, the increased power of air and/or water can allow for new mechanical applications of the faucet including but not limited to the driving of mechanical turbines such as a handheld blender, juicer, or the like 2025.

Currently there are three main forms of batteries referenced in this invention: chemical batteries which lose power over time; large pneumatic tanks which are too big to be mobile; or small pneumatic canisters which cannot be recharged. In fact, all existing pneumatic tanks are considered too technical to recharge for the average member of society and therefore are unsafe for consumer use in the home.

Figure 6:
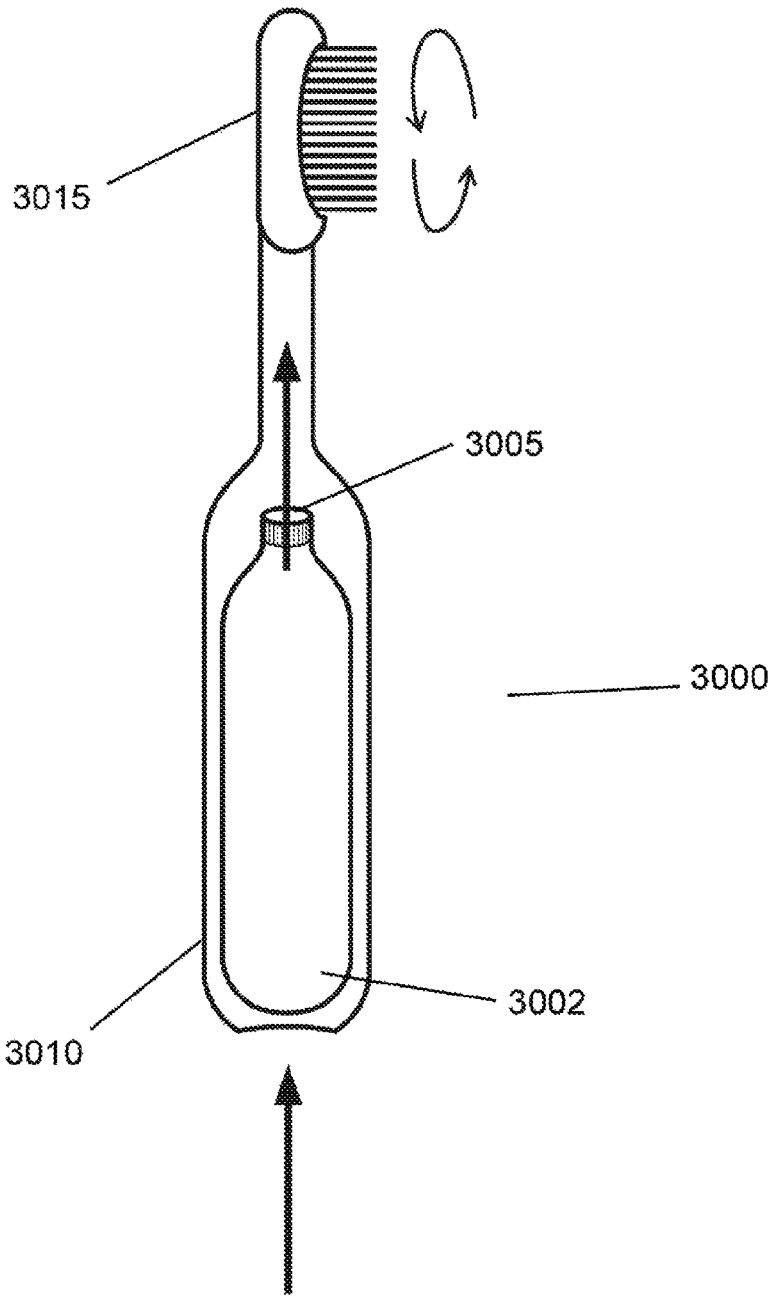
FIGS. 6, 7 and 8 show an apparatus and method for recharging pneumatic batteries using air pressure.
Figure 7:
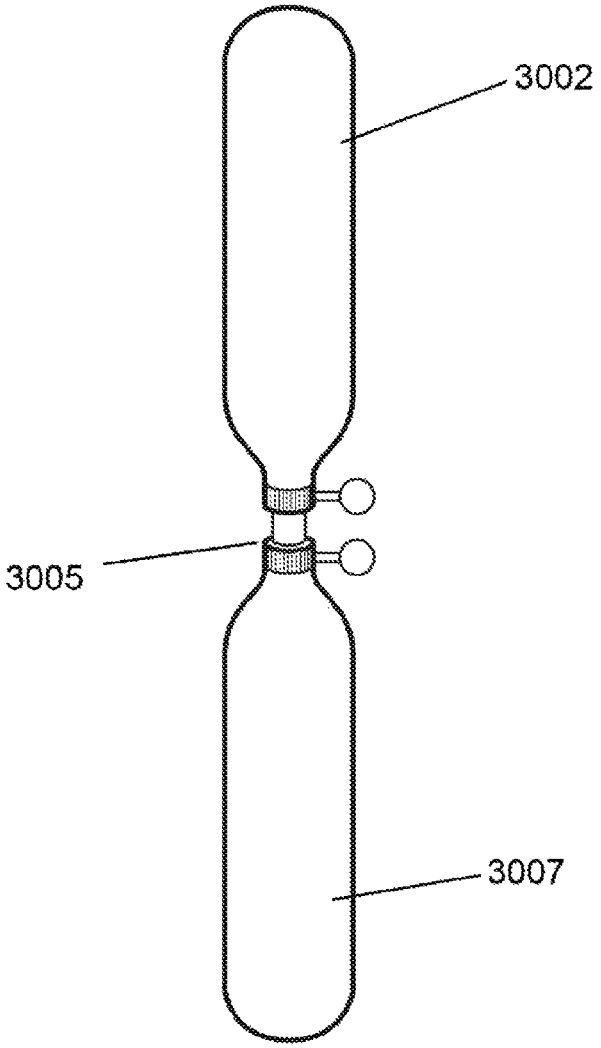
Figure 8:
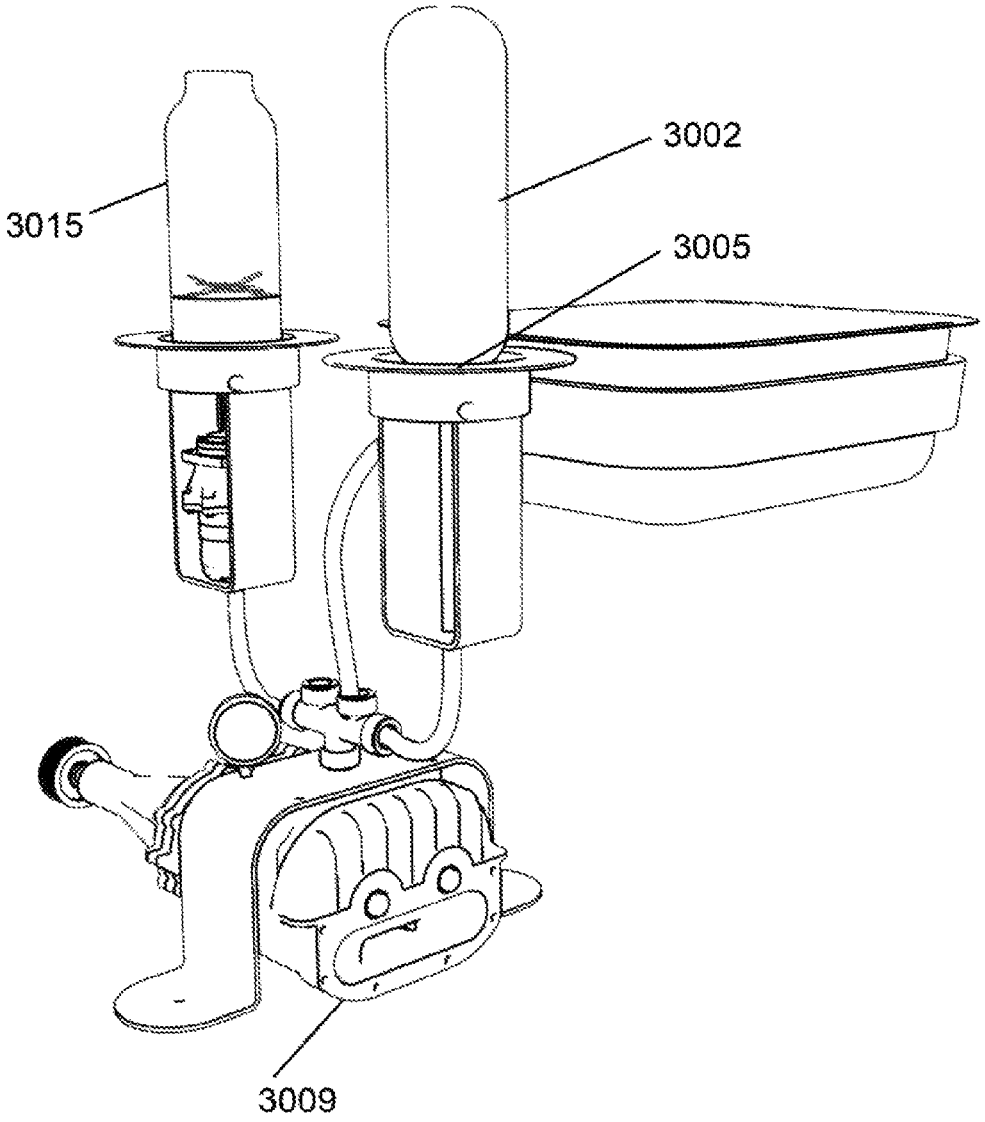

In the embodiment of FIGS. 6, 7 and 8 a small and mobile pressurized air canister 3000 is provided for use in or beside a range of mobile, air powered devices (e.g. a toothbrush in FIG. 6) and which is able to recharge simply. It comprises a small tank 3002 made from a strong material (eg: steel, carbon fiber, etc. . . . ) and containing a user friendly refill valve 3005 which comprises a screw on, clip on or other type of generally known assembly and is filled by either higher pressure air in a source tank 3002 to flow into a battery tank 3007 until the pressure is either equalized or the maximum pressure in the battery tank 3007 is reached or an air compressor 3009 (either electronic, manual or some other type) connected to the battery tank 3007. A universal battery housing 3010 allows appliances to safely consume the air in the canister in order to run the appliance 3015.

Currently the most documented quickest way to cool consumer products (eg: beverages, etc. . . . ) in the household is to combine salt with ice water and plunge the product into it for up to 5 minutes. However this takes a relatively long time, is messy and requires access to ice and salt.

Figure 9:
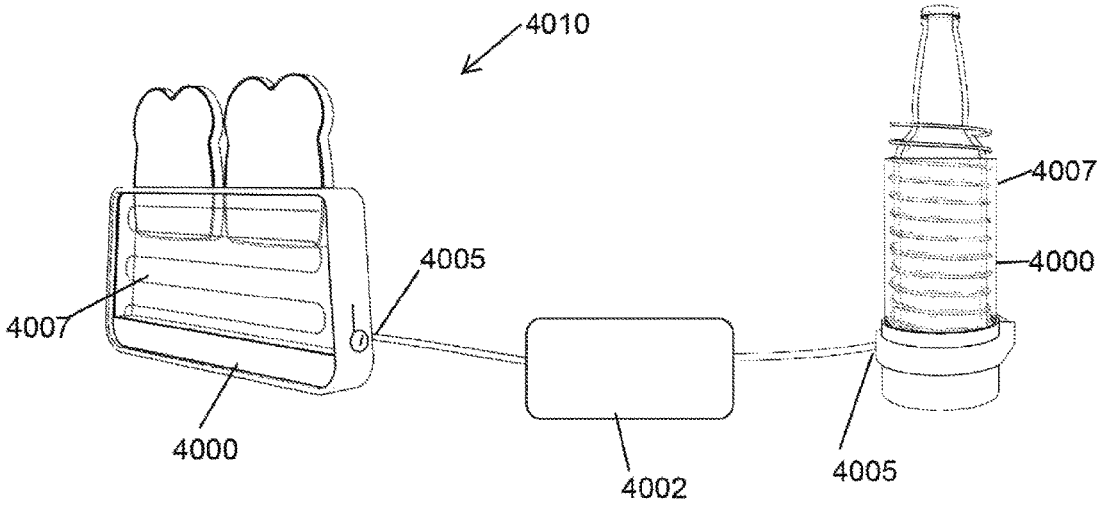
FIG. 9 shows a rapid product cooling (or heating) device using air pressure.

An embodiment of the invention shown in FIG. 9 comprises a product container 4000 which is either single unit or a larger area/multiple unit version, free standing or contained within an already cooled environment (eg: fridge, freezer, esky, or the like) and contains a source of compressed air travelling through a vortex tube 4002, an inlet valve 4005 for the vortex heated or cooled air to enter cavities 4007 or specifically designed air outlet points to effect the temperature of the product. By replacing vortex cooled air with vortex heated air, the device can also rapidly heat particular household items like a toaster 4010, for example.

Currently there are a number of necessary appliances in the modem home which each perform specific tasks and have significant amounts of excess/unused capacity (i.e. they're usually not being used). Specifically the dish washer and the oven which take up considerable amounts of space yet undergo similar functions of heating.

Figure 10:
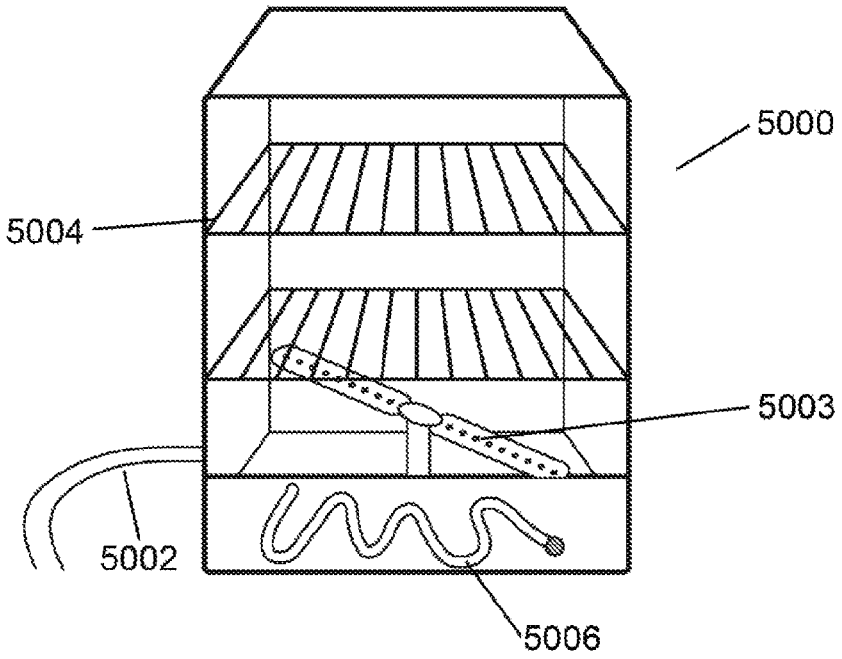
FIG. 10 shows a pressure enhanced apparatus for the combined cleaning of cooking and cleaning.

In the embodiment of the invention shown in FIG. 10 a single unit 5000 comprising a water inlet 5002 and high pressure water and/or steam outlets 5003; racking 5004 to contain the subjects to be cooked and/or cleaned; a heating element 5006. The container unit 5000 can either be at atmospheric pressure or sealed to provide benefits of pressurized cooking and cleaning. The apparatus 5000 can be operated in a cook mode which activates either the heated water and steam for steam cooking and/or the heating element for dry cooking or clean mode which activates the heated water and steam as well as the water and steam jets.

Currently to infuse additives (eg: marinades, sauces, spices, etc. . . . ) into food and drinks (eg: meat, liquors, etc. . . . ) you need to manually agitate the subject and leave it to absorb the additive.

Figure 11:
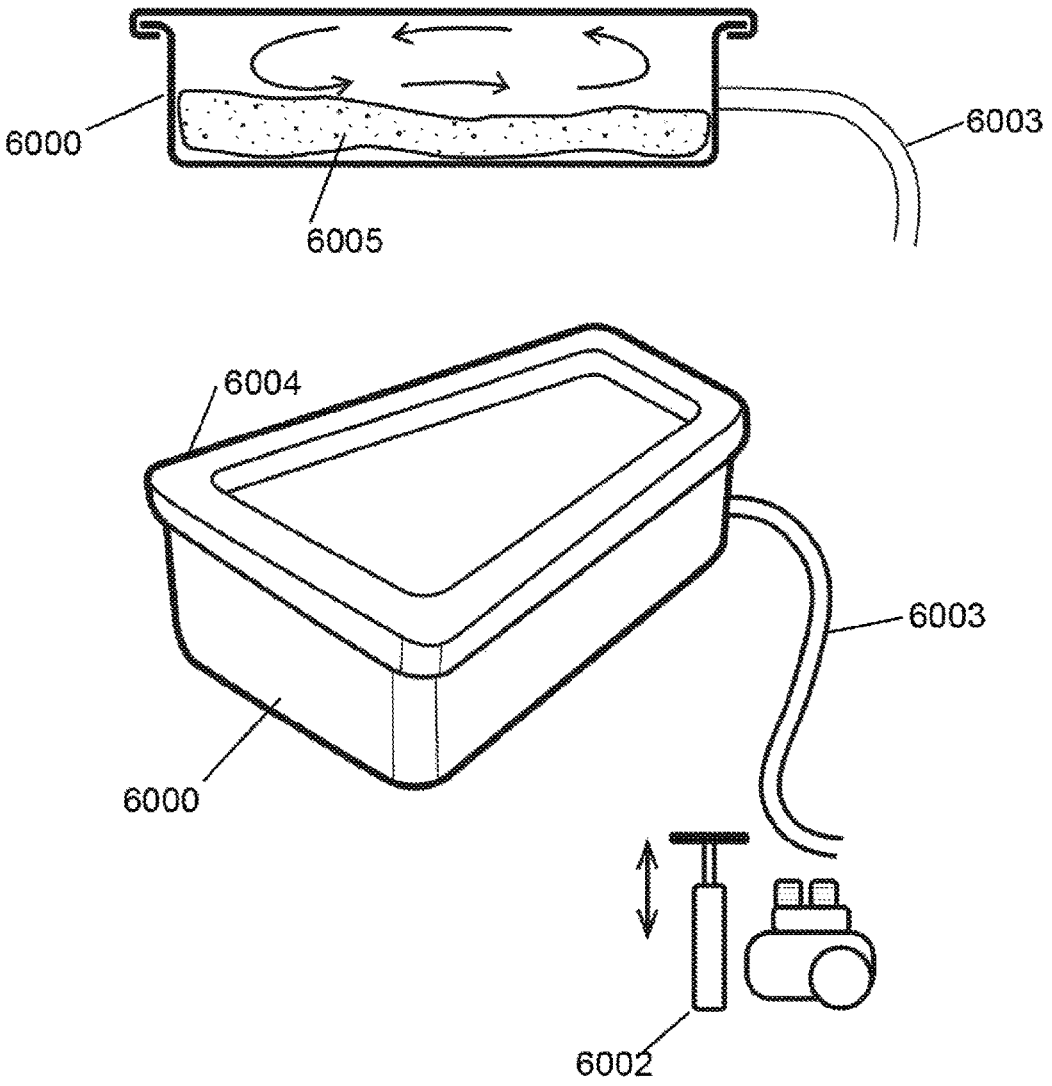
FIG. 11 shows a rapid food and drink additive infusion chamber using air pressure.

In the embodiment of the device shown in FIG. 11 a chamber 6000 is connected to an air supply (either an air compressor or other) 6002 via a hose 6003 and can be sealed with a lid 6004. The subject and the additive 6005 are placed inside the chamber or container 6000 and the chamber pressurized with air for a significantly shorter time frame than existing cooking techniques.

Currently there are a number of ways of drying materials (eg: people, dishes, clothing, etc.) in the home. Applying a manual process with materials which transfer the water from one thing to the other (eg: towel drying); placing the materials aside to have the moisture evaporate from them (eg: clothes line, dish rack, or the like) which takes a long time and takes up a lot of space; applying heat to them in a sealed container (eg: clothes dryer, dish washer, or the like) which can ruin the subject to be dried, still takes a long time and can use a lot of power; or applying an electrically powered air knife (eg: Dyson Air Blade™ hand dryer) which is limited in its size and strength, makes a lot of noise and uses up a lot of electricity.

Figure 12:
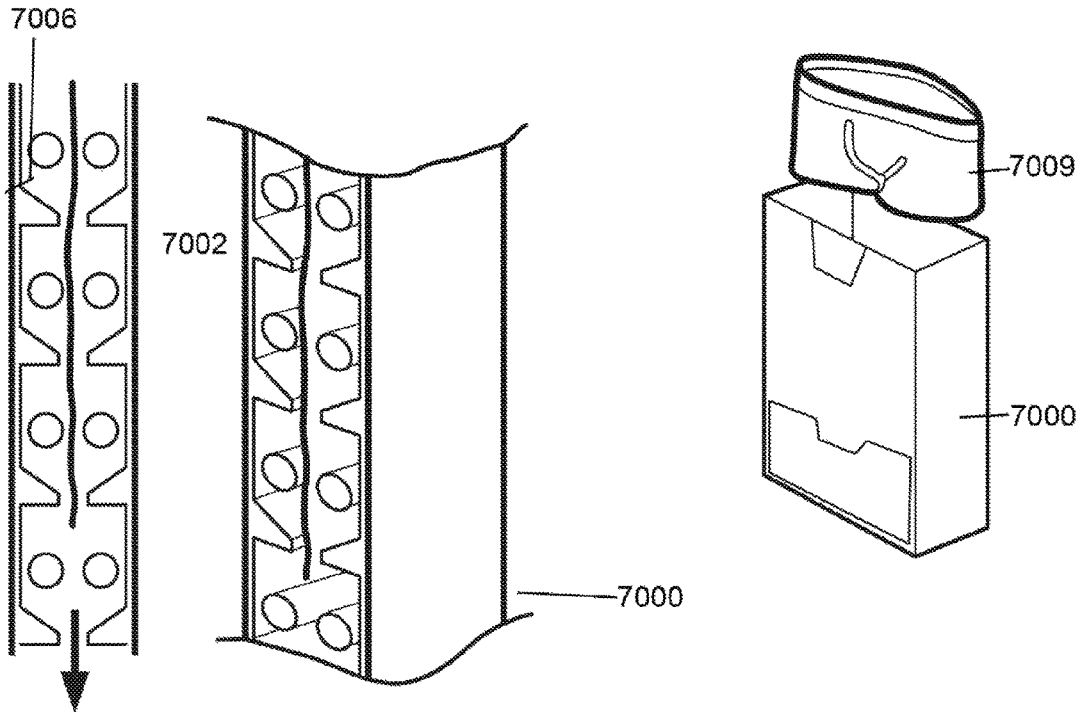
FIGS. 12 and 13 show a pneumatic air pressure apparatus and method for drying in the household.
Figure 13:
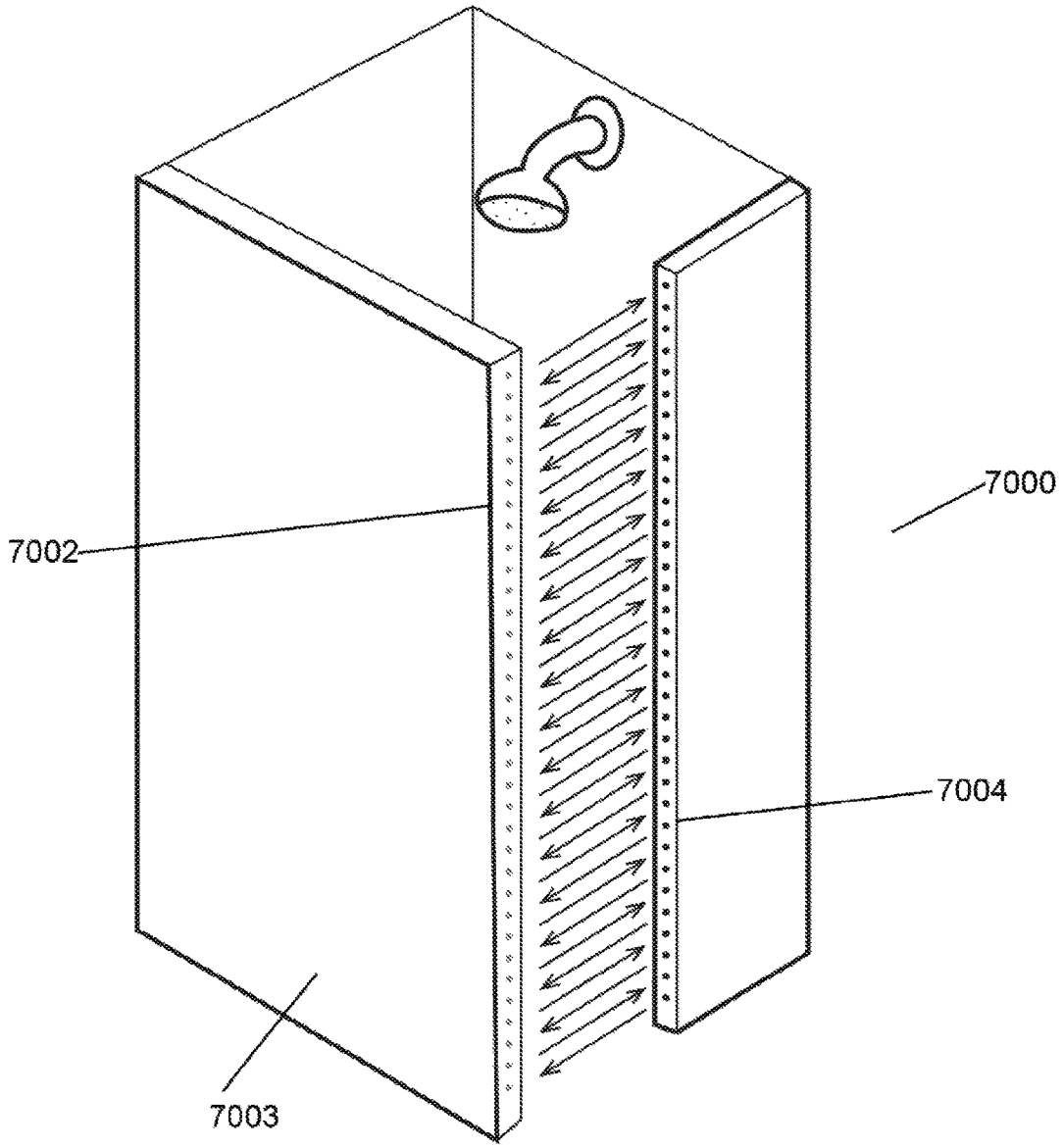

The apparatus shown in FIGS. 12 and 13 comprise a pneumatic air supply (not shown), either attached to the unit 7000 or in a different physical location (not shown). The unit 7000 is made up of a number of air knives 7002 arranged in an assortment of ways (eg: two knives opposite each other, one large one in a line, or the like). A water catchment reservoir 7003; a heating element 7004 and other inclusions such as rolling devices 7006 are provided for the purpose of drying a range of household items (eg: clothing 7009), a person, dishes, car, or the like).

Currently many liquids (eg: milk, wine, or the like) are stored in bulk quantities for commercial applications in large plastic bags. Because of the lack of structural support and/or handles, these bags are difficult to handle, transport and store and often are dropped or ruptured as a result.

Figure 14:
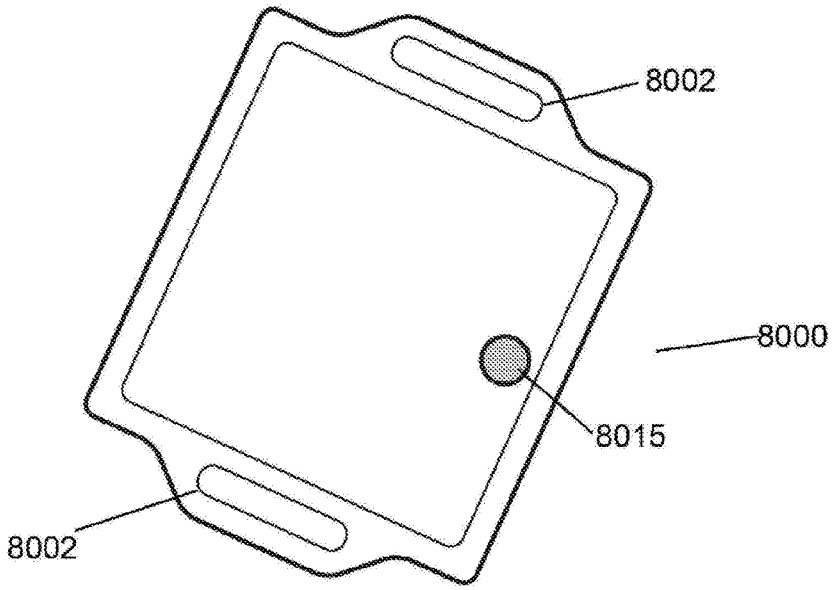
FIGS. 14 and 15 show improvements to transport of commercial pressurised liquid containers.
Figure 15:
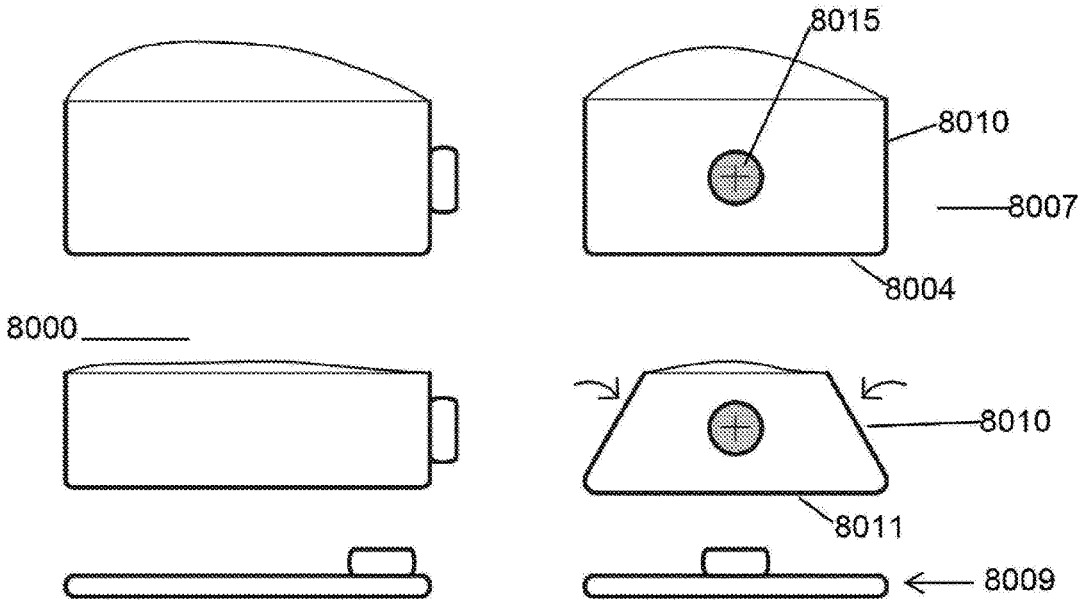

The embodiment shown in FIGS. 14 and 15 comprise an improvement to traditional commercial liquid storage bags where handles 8002 and/or structural supports 8004 are added to the bag 8000 itself to aid the handling, storage and transport for the bags. In FIG. 15 as the bag's contents go from full 8007 to empty 8009, the bag's rigid walls 8010 collapse onto the rigid base 8011 to pack down flat for disposal. The bag 8000 also includes a pressurised connector valve 8015.

Figure 16:
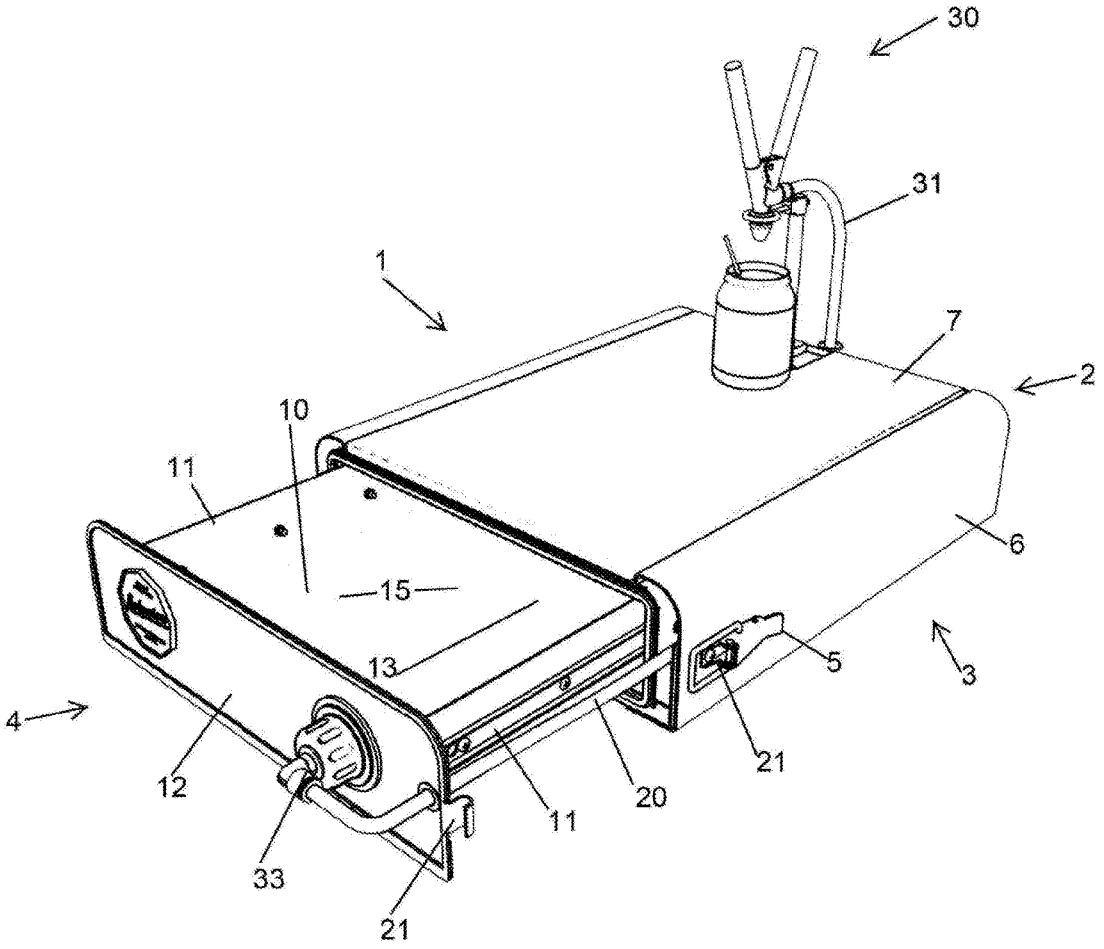
FIG. 16 is a stylized view of a liquid delivery system of an embodiment of the present invention with the compartment open.

Turning to FIGS. 16 to 39 there is disclosed herein a liquid delivery assembly 1 having at least one liquid delivery module 2. Each delivery module 2 includes a housing 3 and an associated compartment 4. The housing 3 has a top surface 4, bottom surface 5, side walls 6, a closed end 7 and an open end 8. The compartment 4 includes a bottom floor 10, side walls 11, a front wall 12, a back wall 13 defining a space 15 therebetween. As best seen in FIG. 16, the compartment 4 is locatable within the housing 3 and moveable with respect to the housing 3 to permit access by a user to the compartment 4 and in particular the space 15. Though the module 2 is shown as a rectangular prism it could be any suitable shape. For example, square prism, pyramid prism, cone prism, cylindrical prism, polygon prism or the like.

In the preferred form, the compartment 4 takes the form of a drawer and includes associated drawer railings 20 of the common type located on the side walls 11 and inside surfaces of walls 6 to allow the drawer 4 to move smoothly into and out of the housing 3. A lock 21 can be included to lock the drawer 4 in a closed or secured position to the housing 3. The lock 21 can take many known forms. For example, as shown includes a hook and catch mechanism or the like. The space 15 is adapted in use to receive a receptacle 25 (or bag) adapted in use to contain a liquid to be dispensed by the assembly 1 to a user. The assembly 1 further includes a liquid dispenser 30 which includes a conduit or tube 31 extendable in use from a dispensing nozzle 32 to a liquid receiving connector 33. The liquid receiving connector 33 is adapted to releaseably connect to the liquid receptacle or bag 25 by way of a connector or cap 50.

In a preferred form, the compartment 4 in an open position (see FIG. 16) provides access to the space 15 which is adapted to receive the receptacle 25. When the compartment is in the closed position (see FIG. 17) the compartment is sealingly engaged with the housing 3. The lock 21 can ensure that the compartment 4 does not open when the bag 25 is under pressure.

Figure 21A:
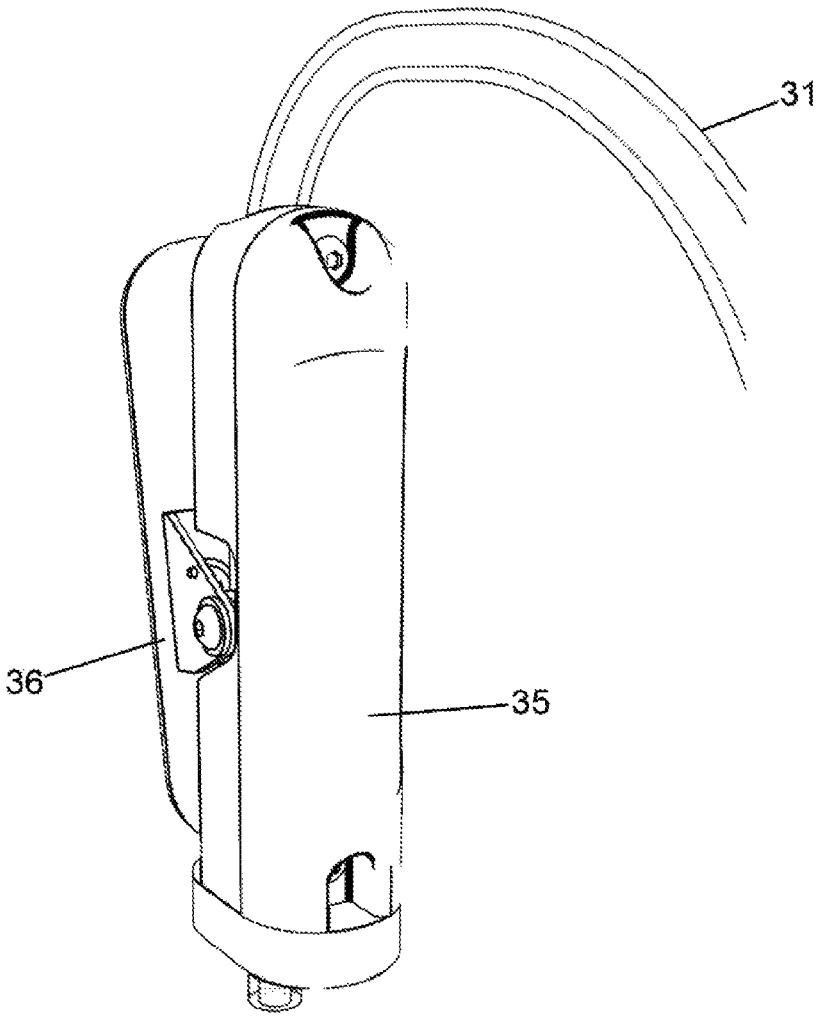
FIGS. 21*a* and 21*b* show a actuating handle for use with the system of FIG. 16.
Figure 21B:
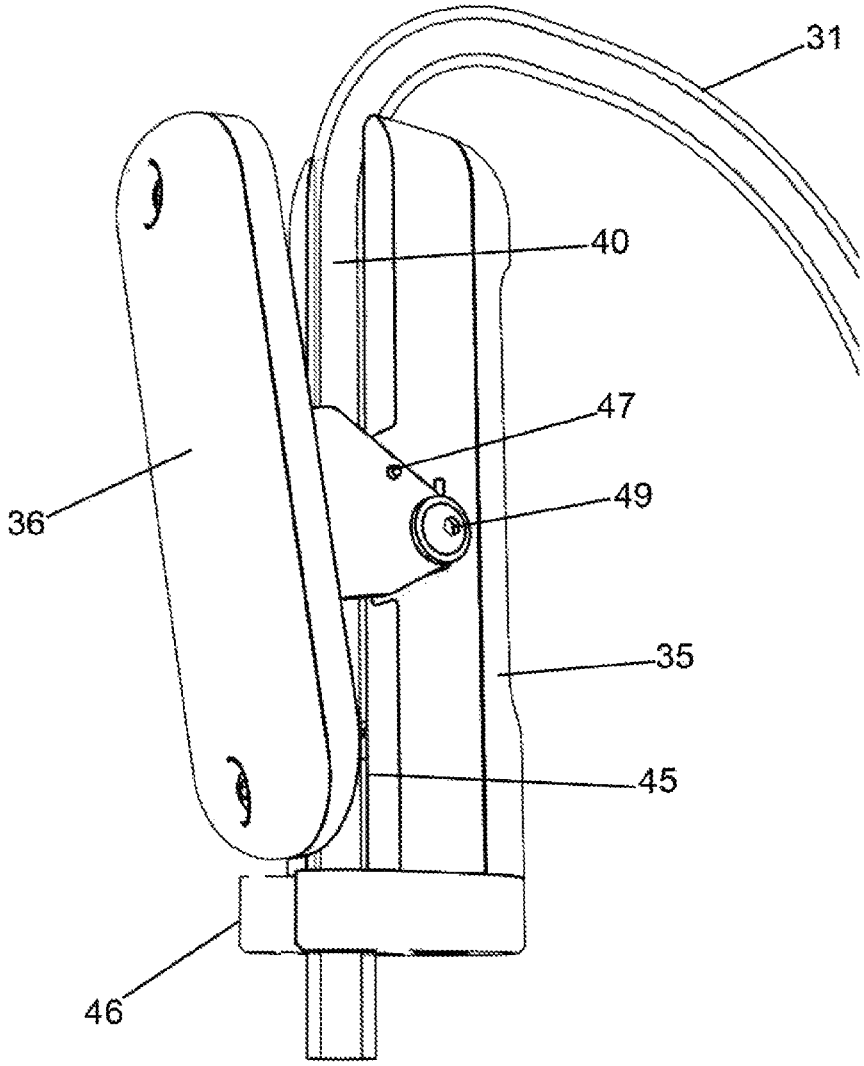
Figure 22:
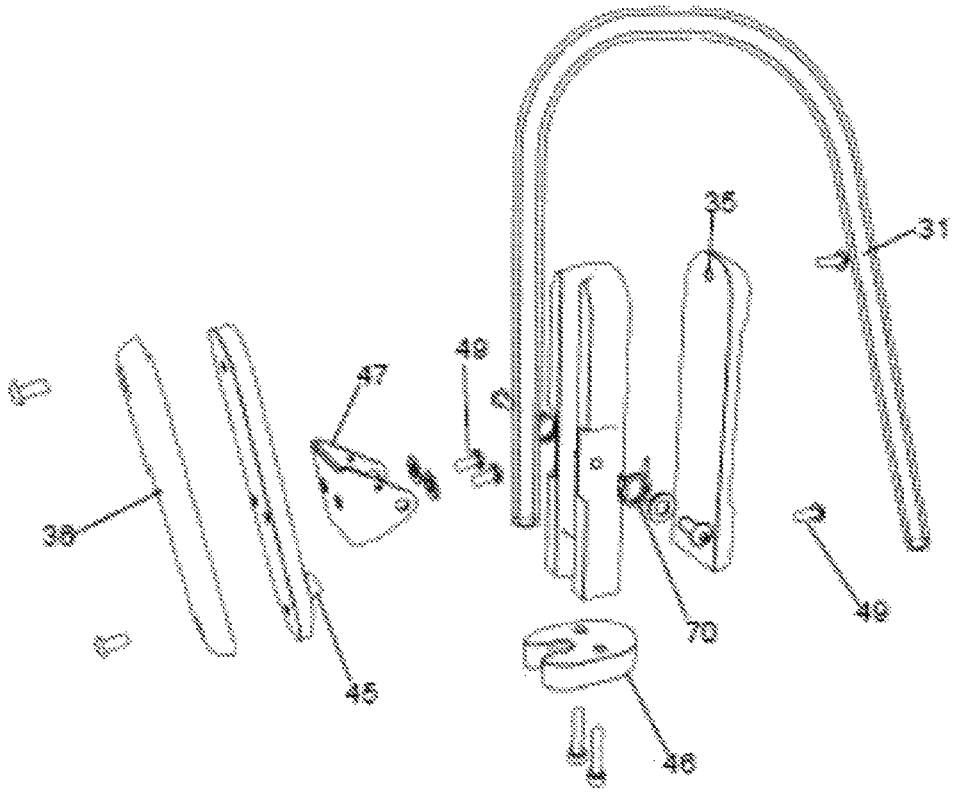
FIG. 22 shows a parts exploded view of FIGS. 21*a* and 21*b;*
Figure 23:
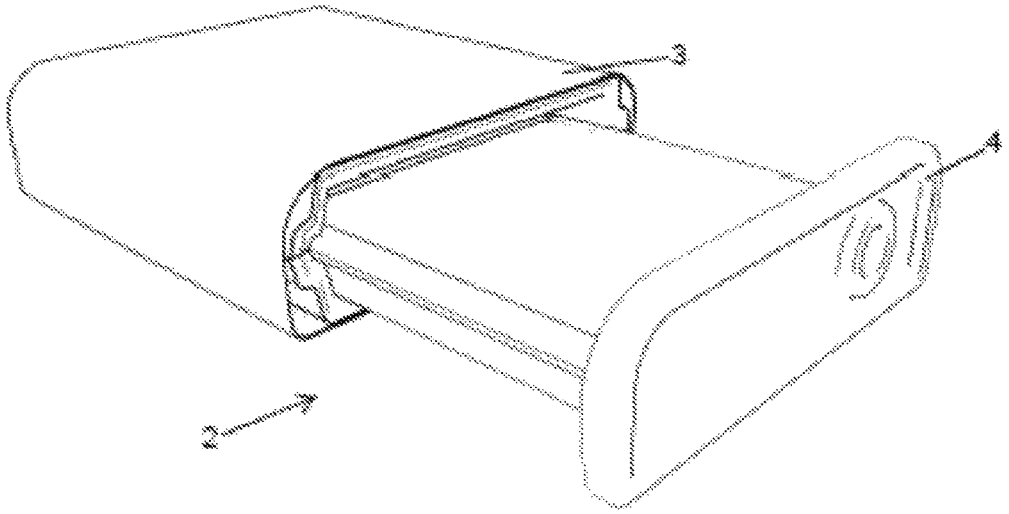
FIG. 23 shows the processed liquid delivery system module of FIG. 16 moulded.

As best seen in FIGS. 21*a* and 21*b*, the dispenser 30 includes a handle 34 extending from the nozzle 32. The handle 34 connects with the conduit 31. The handle 34 is shown having a fixed arm 35 and a moveable or pivotable arm 36. Various other embodiments of the handle 34 are useable for example as shown in FIGS. 21*a*, 21*b*. In those figures, a further version of the handle 34 is shown where the fixed arm 35 includes a groove 40 to receive the conduit 31 and the pivot arm 36 includes a stopper 45 which when pressed by a user will stop flow of liquid through the conduit 31. The handle 34 includes a guide 46, fasteners 49 and springs 70 to maintain the handle 34 along with a pivot plate 47 adapted to help pivot the movable arm 36 from the fixed arm 35. The handle 34 can include an ergonomic grip (not shown) or the like.

Figure 17:
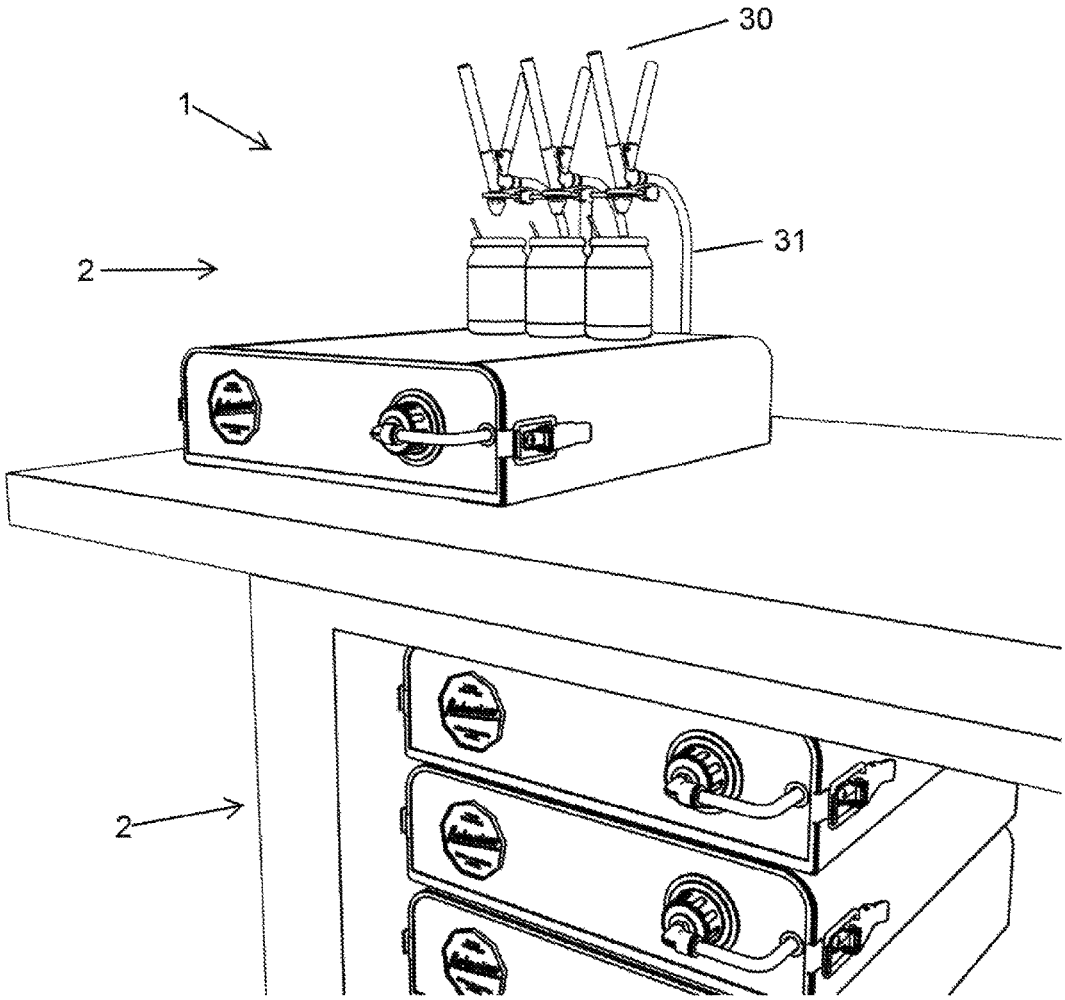
FIG. 17 shows FIG. 16 with the compartments closed and with multiple nozzles and modules shown.
Figure 18A:
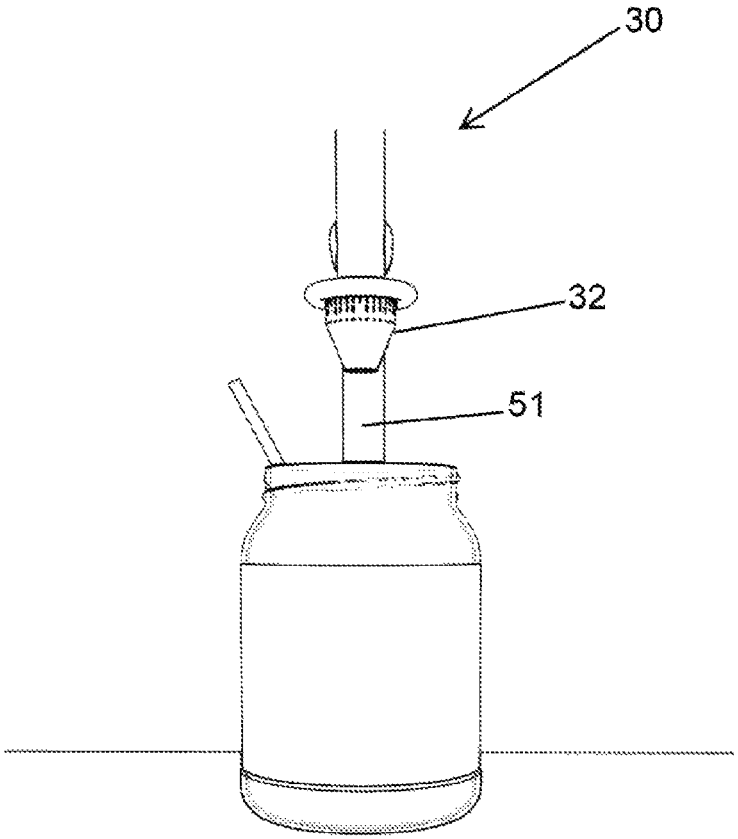
FIGS. 18*a* and 18*b* shows a delivery mechanism for delivering liquid to a user of the system of FIG. 16.
Figure 18B:
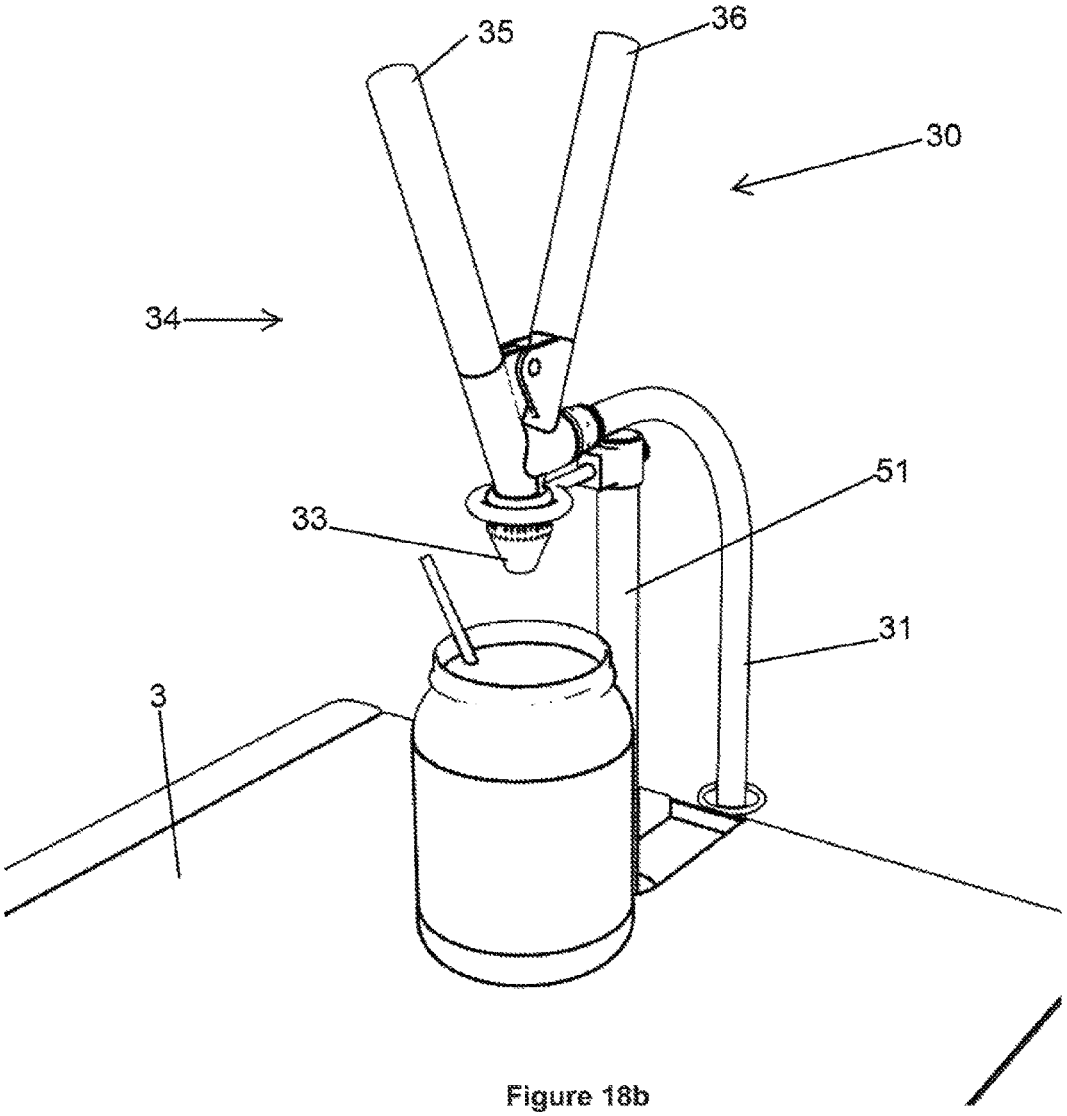
Figure 19:
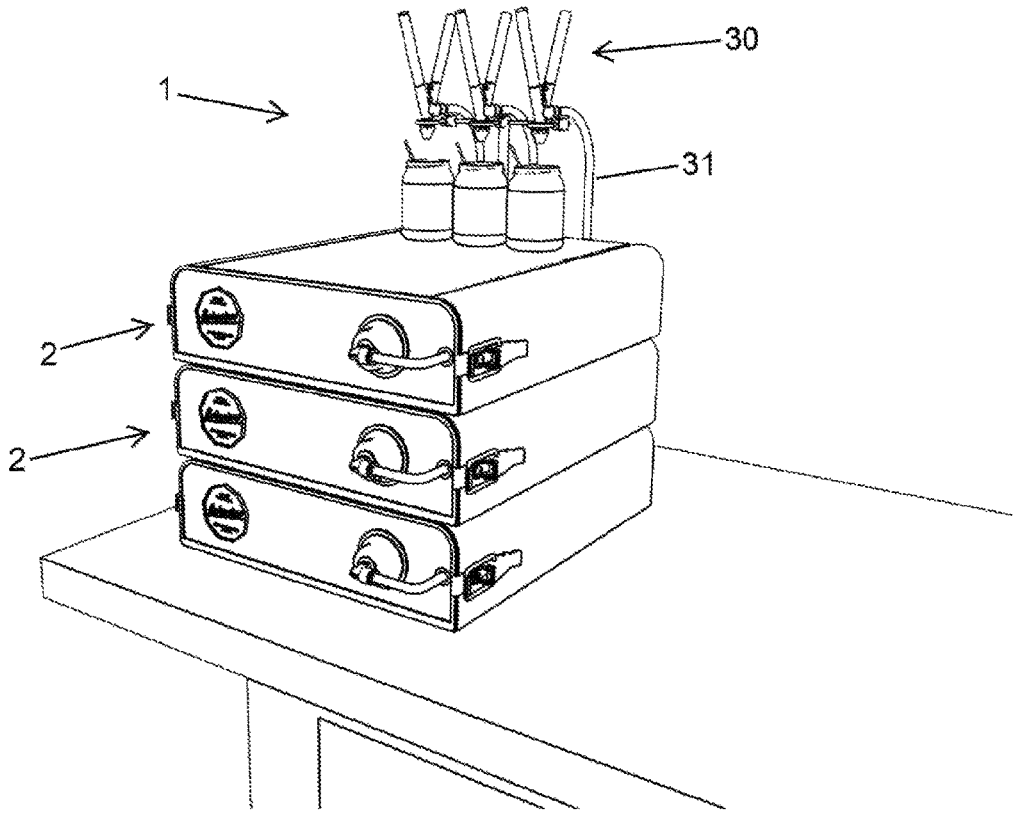
FIG. 19 shows a number of liquid delivery system modules of FIG. 16 connected together.
Figure 20:
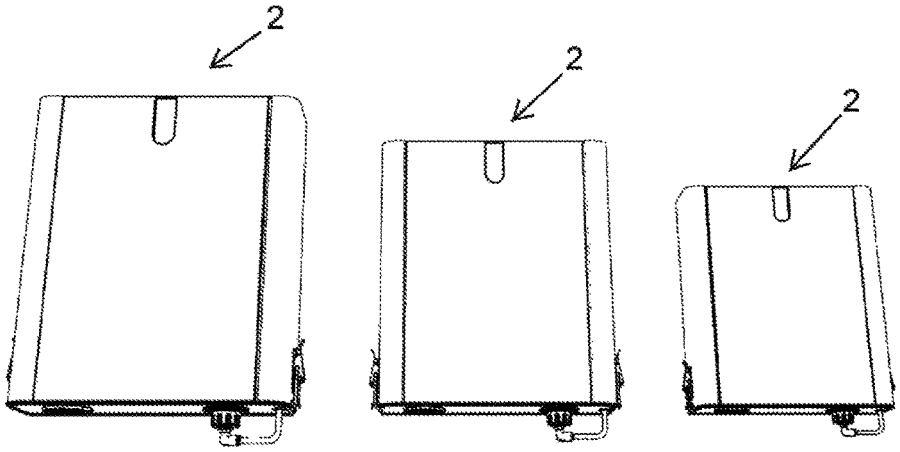
FIG. 20 shows a number of different sized liquid delivery system modules of FIG. 16.

As shown in FIG. 17, one or more modules 2 can be connected together in series or parallel to allow dispensing of the same or different liquids simultaneously or individually. The assembly 1 may further include a handle mount 51 to assist with the dispensing of liquids through the handle 34 and nozzle 32.

Figures 24A, 24B:
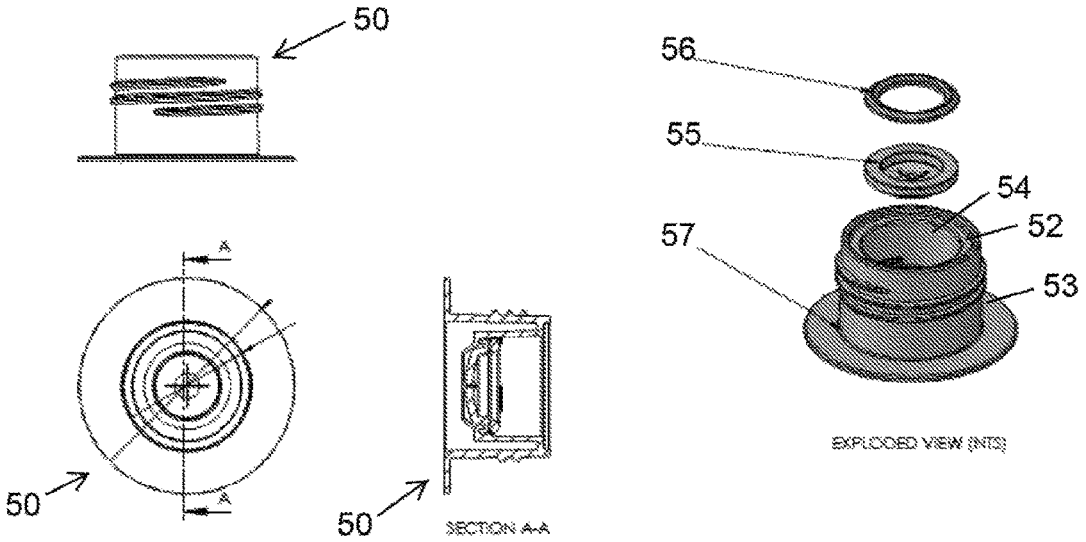
FIGS. 24*a* and 24*b* show a cap for use with liquid bags for use with the liquid delivery system module of FIG. 16.

In FIGS. 24*a*, 24*b* is shown a connector or cap 50 for use with the liquid bags 25 of the delivery system 1. The connector 50 has a flange 57, elongate body 52 including a thread 53 on the outside and an aperture 54. A valve 55 and sealing ring 56 are received in use within the aperture 54.

The connector 50 attaches to a liquid bag 25 and is operatively associated with the connector 60 of a corresponding compartment 4.

Figures 25A, 25B:
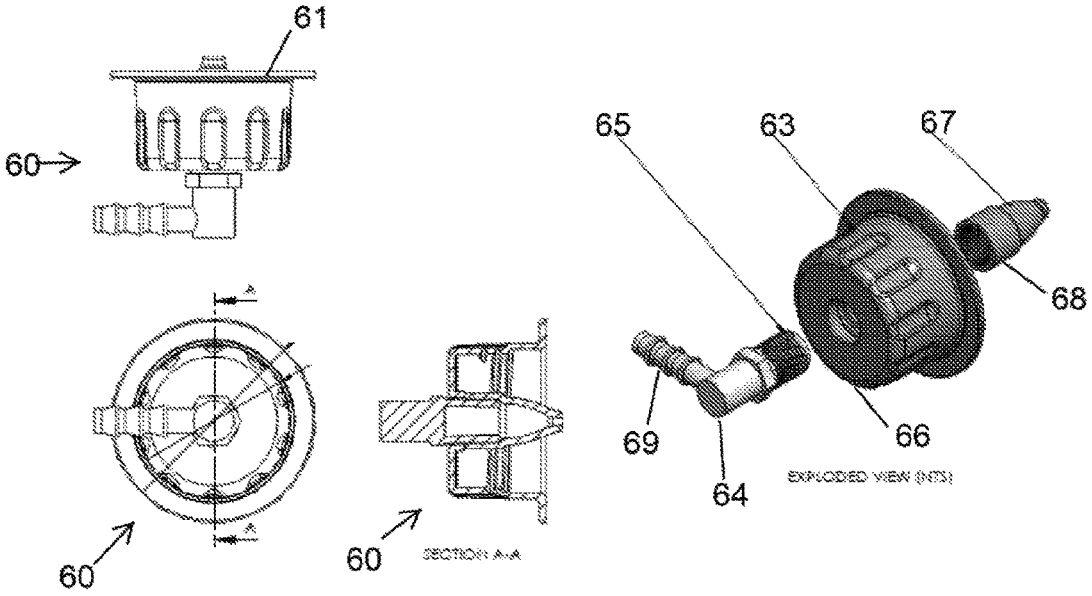
FIGS. 25*a* and 25*b* show an output connector to receive the cap of a liquid bag of the delivery system of FIG. 16.

In FIGS. 25*a*, 25*b* there is shown the connector 60 of the compartment 4 having a flange 61, an elongate body 62 having grooves 63 or the like to assist with installation, a valve piece 64 having a thread 65 to be received within a corresponding thread 66 within the connector 63 and to attach to an insert piece 67 also having a corresponding threaded piece 68. There is also shown an arm 69 to attach to the conduit 31 to extend to the nozzle 32 to be dispensed.

Figures 26A, 26B, 26C:
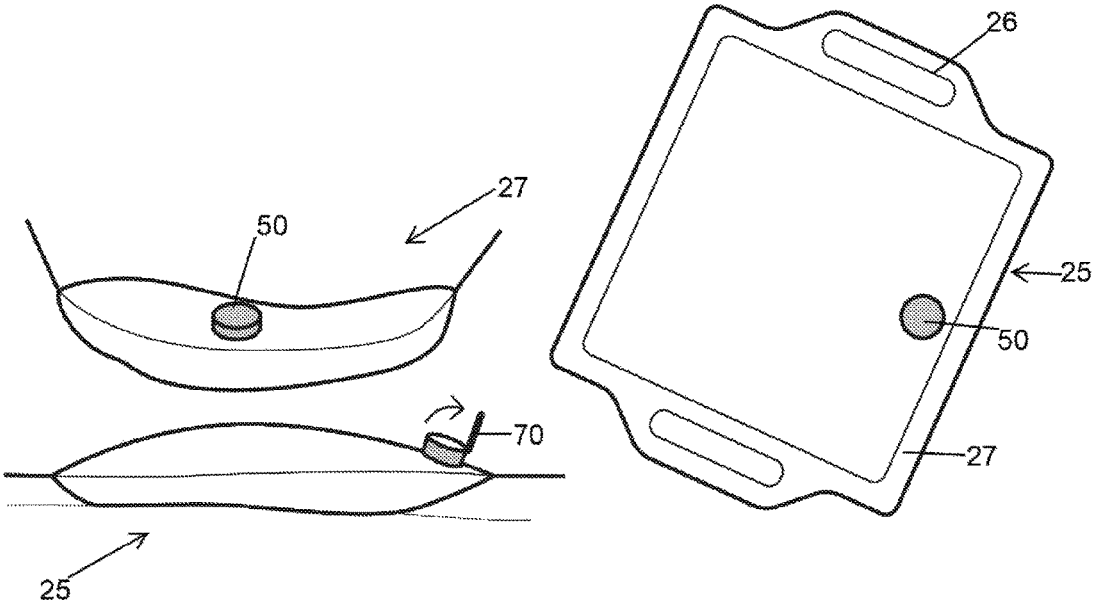
FIGS. 26*a* to 26*c* show liquid pressure bags for use with the delivery system of FIG. 16.

In FIGS. 26*a* to 26*c* there is shown an example of a liquid delivery bag 25 having handles 26 at either side, heat sealed edges 27 and the connector or cap 50 which could include a flip-top lid or cover 70.

Figure 27:
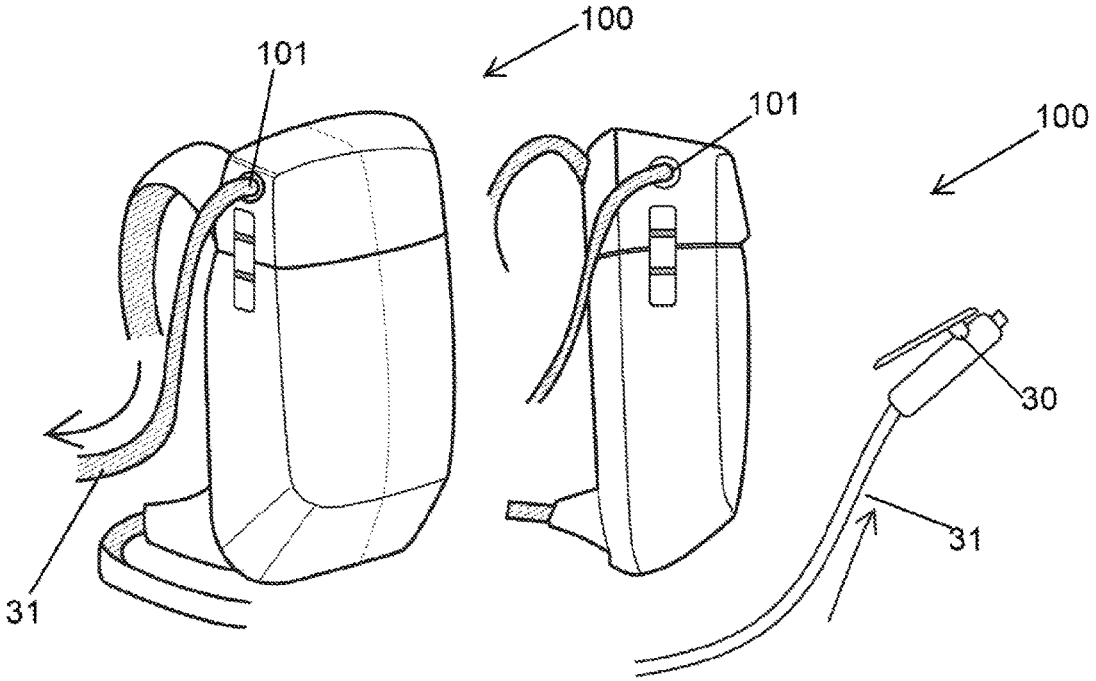
FIG. 27 shows a backpack for use with the system of the present invention.

In FIG. 27 there is shown the assembly 1 of the present invention incorporated into a backpack 100. The backpack 100 being of a standard type backpack having an aperture 101 to allow the conduit 31 to extend from the assembly 1 out to the nozzle 32 to be dispensed by a user.

Figure 28:
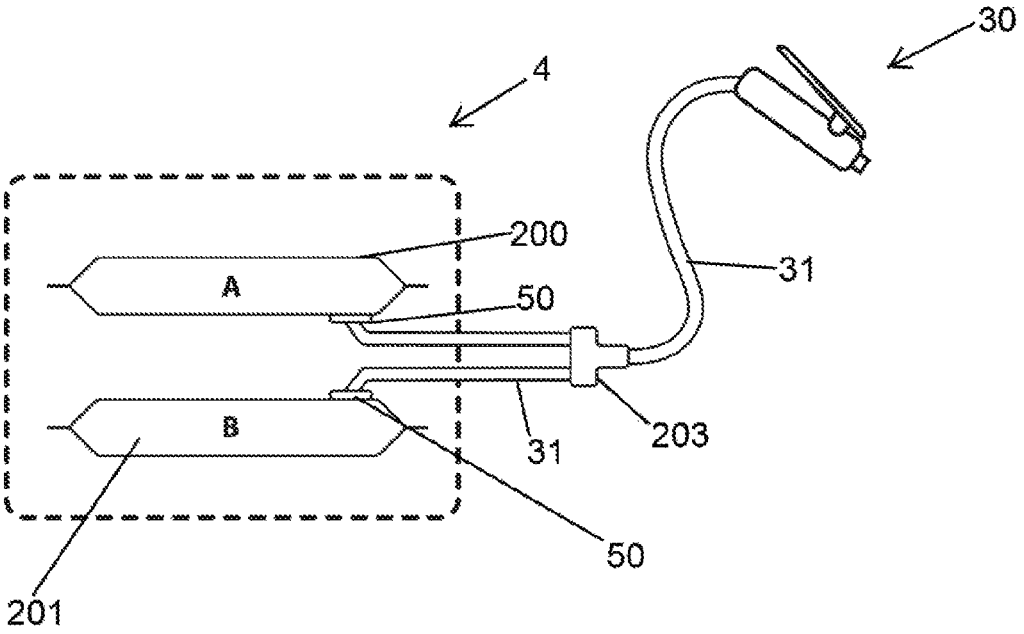
FIG. 28 shows an embodiment of the system of the invention having two bags.

In FIG. 28 there is shown a compartment 4 of the present invention holding two bags 200, 201 connected by a dual connector 203 connecting conduits 31 to allow liquids from two bags 25 to be dispensed simultaneously from a single nozzle 32.

Figure 29:
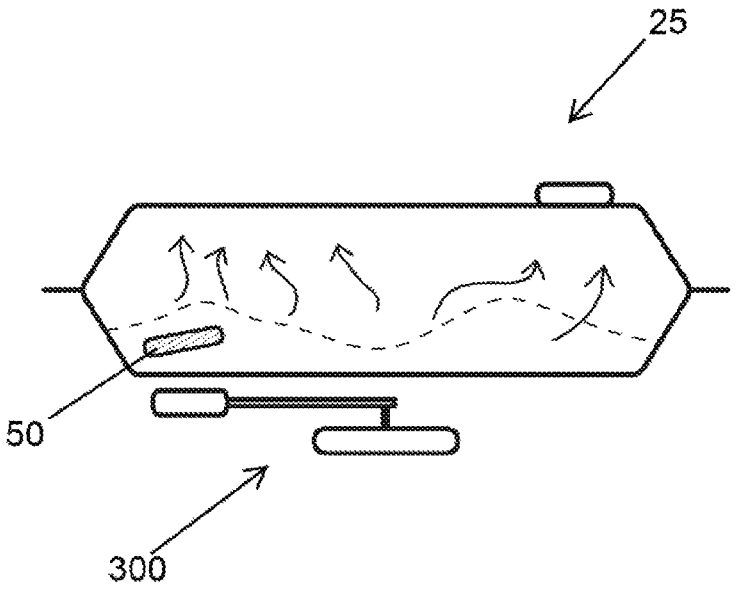
FIG. 29 shows an agitator for use with the system of the present invention.
Figures 30A, 30B:
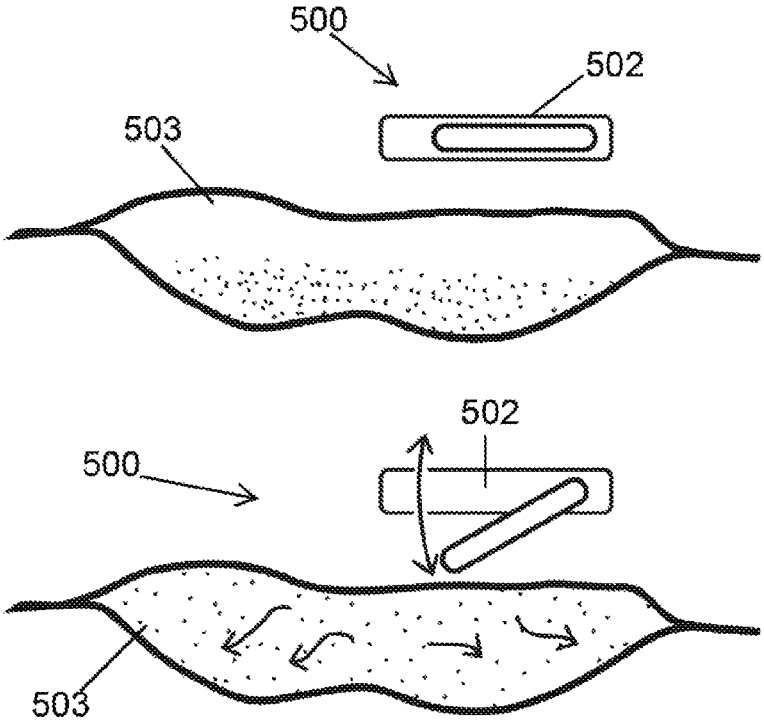
FIGS. 30*a* and 30*b* show further embodiments of the agitators.

In FIG. 29 there is shown a bag 25 of the present invention including an agitator 300 to be utilised within the bag 25 to assist with keeping the liquid within the bag agitated. FIGS. 30*a* and 30*b* show further embodiments of agitators of the present invention. The arm 500 is driven by a motor 502 and moves up and down or in any suitable direction. This action depresses the bag 503 and creates a wave in the liquid located within the bag 503. The wave then creates enough movement to disperse sediment if any is located in the bag and mix it with the liquid in the bag.

Figure 31:
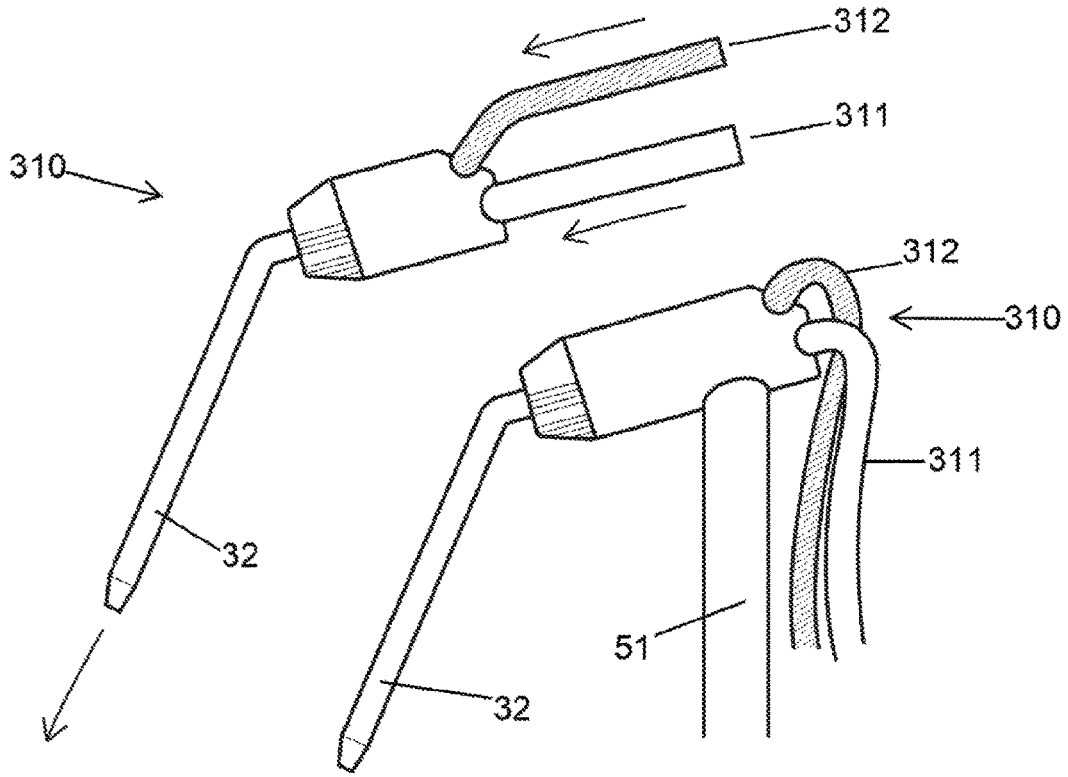
FIG. 31 show an in-line frothier for use with the system of the present invention.
Figure 32:
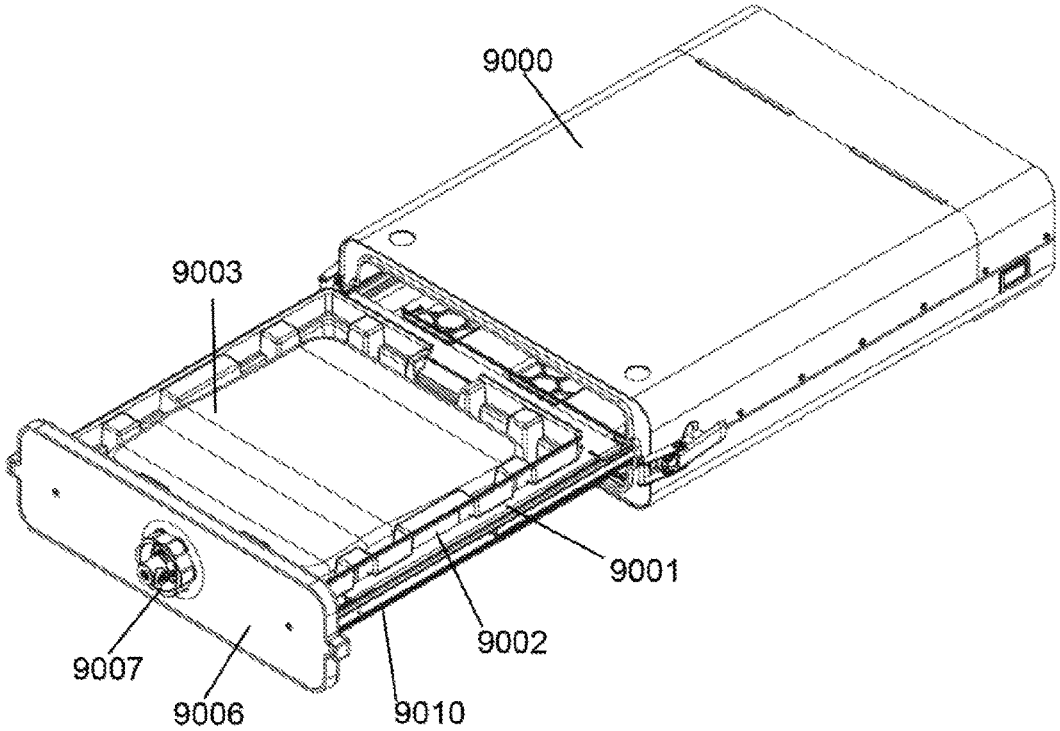
FIG. 32 shows a further liquid delivery module of an embodiment of the present invention.

In FIG. 31 there is shown a frother 310 to be used with the present invention. The frother 310 including a liquid line 311 and a hot air line 312 to assist with frothing liquid to be dispensed from the nozzle 32.

Figure 33:
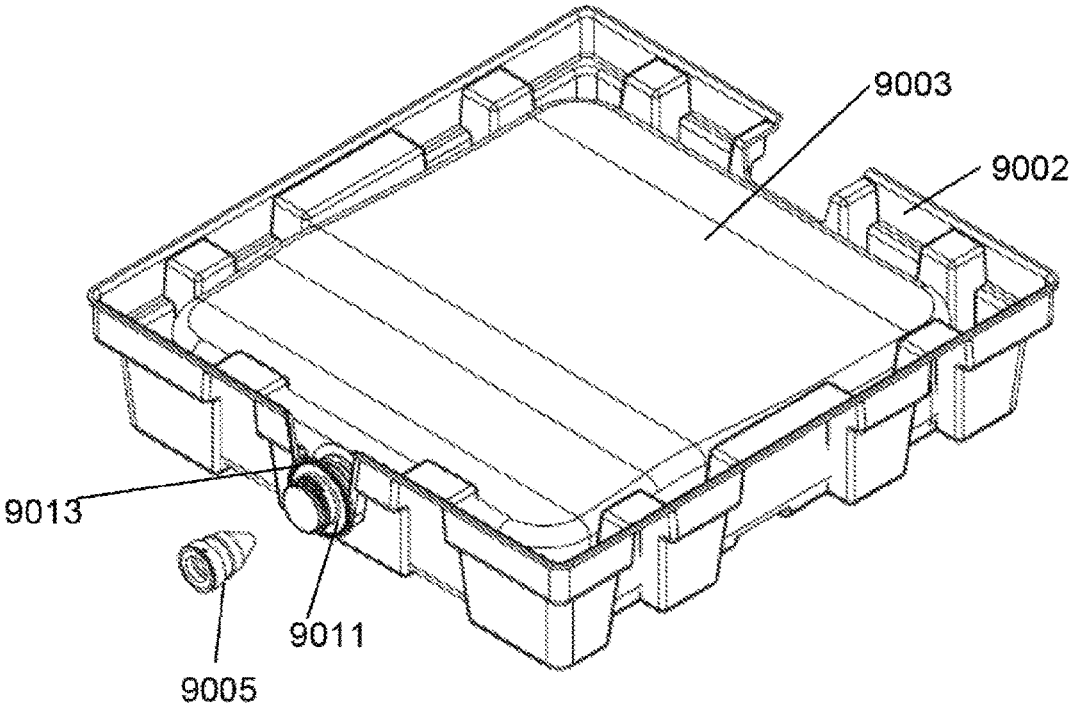
FIG. 33 shows the cartridge tray and bag of FIG. 32.
Figure 34:
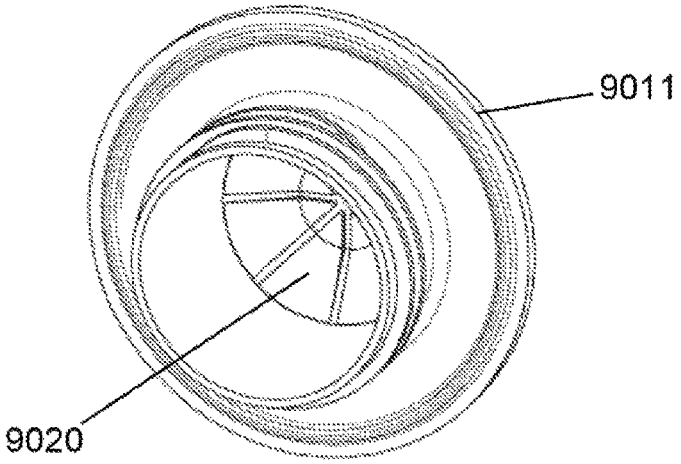
FIG. 34 shows the connector of FIG. 32.
Figure 35:
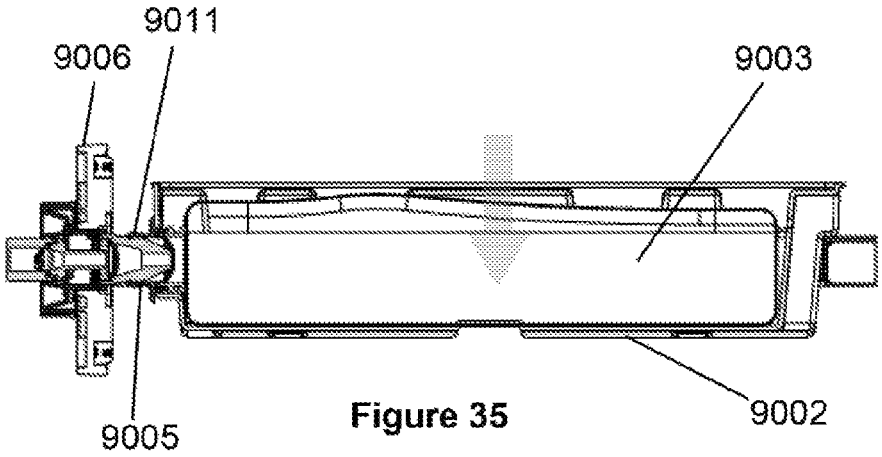
FIG. 35 shows the delivery system in use step 1.
Figure 36:
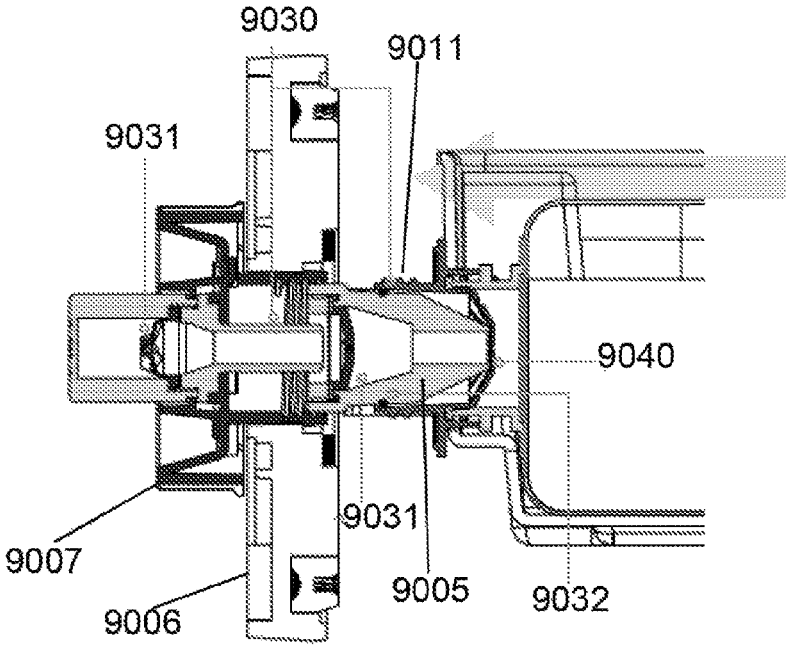
FIG. 36 shows the delivery system in use step 2.
Figure 37:
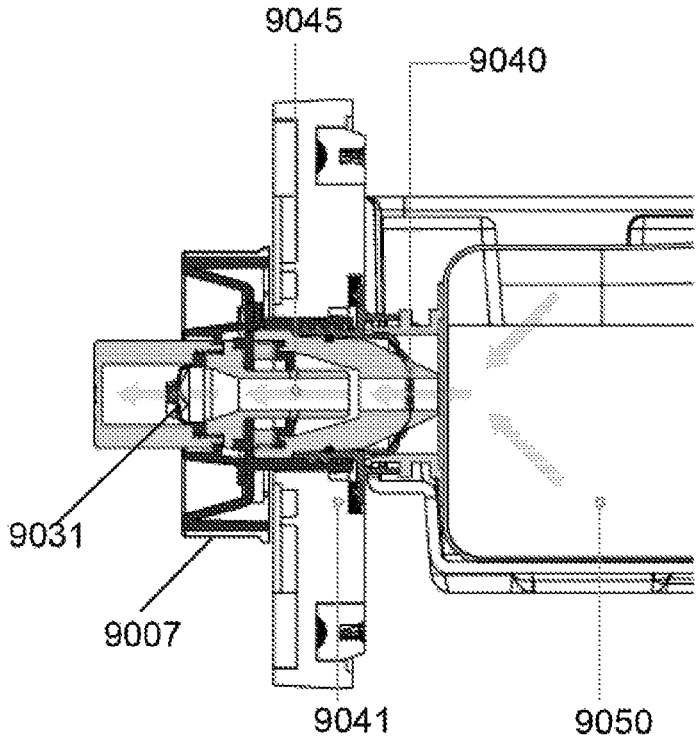
FIG. 37 shows the delivery system in use step 3.
Figure 38:
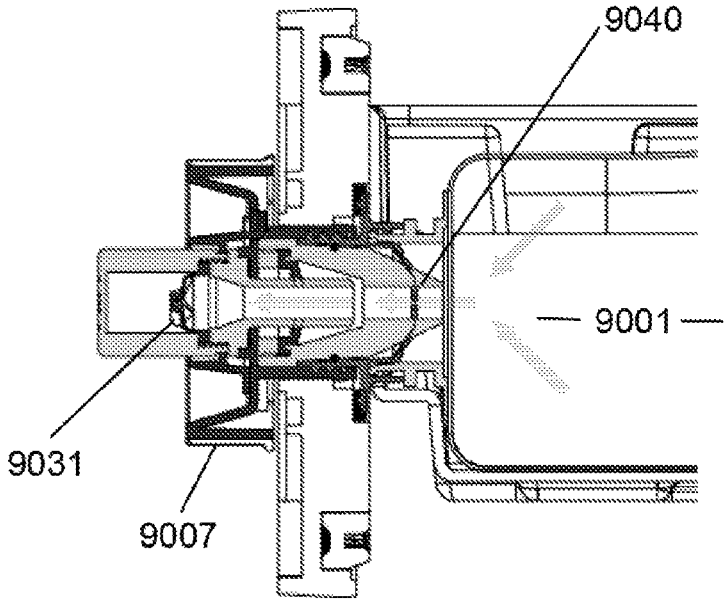
FIG. 38 shows the delivery system in use step 4.
Figure 39:
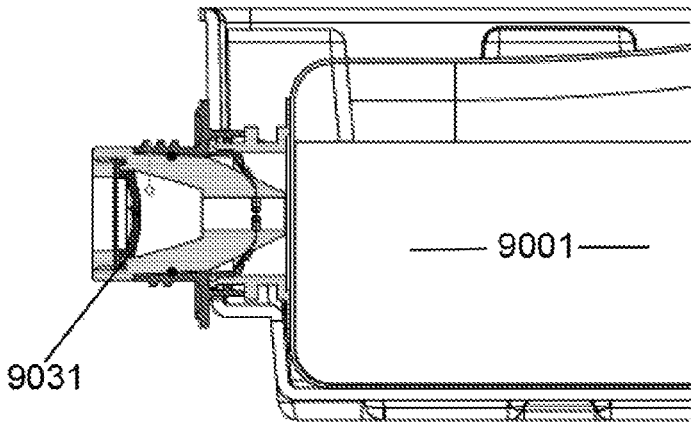
FIG. 39 shows the delivery system in use step 5.

In FIGS. 32 to 39 are further embodiments of the module 2 of FIG. 16. In this embodiment, the main housing 9000 and pressure chamber 9001 with integrated refrigeration (not shown) have a crate, tray or insert 9002 to hold the bag 9003. The bags 9003 arrive as a package with the crate 9002 included and can be inserted into the main housing 9000. As seen in FIGS. 33 and 34 there is a piercer 9005 on the other side of the drawer front 9006. The dial 9007 has a secure valve 9013 to the bag 9003. The drawer 9010 receives the crate 9002 which holds the bag 9003. The piercer 9005 interacts with a bag cap 9011 which will connect with break-away tabs 9020 which keep the bag 9003 sealed until broken in the chamber 9001.

As shown in FIGS. 35 to 39 when installing the crate 9002 and bag 9003 into the chamber 9001, the piercer 9005 needs to be first pushed into the bag cap 9011 to get an initial seal. The crate 9002 is then placed into the lower drawer receptacle. When pushed into position, the matching threads 9030 are engaged and the one-way valve 9031 keeps the seal intact. The rubber O-ring 9032 creates the seal with the one-way valve 9031. The crate 9002 is then pushed into position. The front dial 9007 is turned to engage the thread 9030 and draws the crate in to it. The outlet pathway 9045 breaches the one-way valve 9031 as the dial 9007 is turned and the end of the piercer 9005 is compressed against the break way finger 9040 eventually breaking them. The flange 9041 on the cap 9011 compresses the gasket 9032 and creates an air tight seal isolating the bag 9003 from the chamber 9001.

An open pathway 9050 is created when fully engaged multiple things occur. The drawer is then closed and the pressure chamber 9001 is created and sealed. Liquid is dispensed when pressure in the chamber increases. When fully dispensed, the dial 9007 is rotated to release the crate. The piercer 9005 is released along with the assembly. The one-way valve 9031 creates the seal and the remaining liquid will not spill out.

Although the invention has been described with reference to specific examples, it will be appreciated by those skilled in the art that the invention may be embodied in many other forms.

The invention claimed is:

1. A pressurised liquid delivery assembly having:

at least one liquid delivery module, each said module including:

a housing and an associated compartment, said compartment being a drawer slidably locatable within said housing and moveable with respect to said housing to permit access by a user to said compartment;

said drawer including a removable cartridge defining a space that receives and holds a replaceable pressurised receptacle containing liquid to be dispensed by said assembly;

a liquid dispenser operatively associated with said receptacle and adapted to dispense liquid;

said dispenser including a conduit extendable from a dispensing nozzle to a liquid receiving connector, said liquid receiving connector adapted to releasably connect to said liquid receptacle in use, wherein said assembly further includes a piercer adapted in use to pierce said receptacle to permit liquid located within said bag to flow to said nozzle.

2. The liquid delivery assembly according to claim 1, wherein said compartment in an open position provides access to said space to receive said receptacle.

3. The liquid delivery assembly according to claim 1, wherein said compartment in a closed position sealingly engages said compartment with said housing.

4. The liquid delivery assembly according to claim 1, wherein said receptacle is a pressurised liquid bag.

5. The liquid delivery assembly according to claim 1, wherein said dispenser includes a handle extending from said nozzle.

6. The liquid delivery assembly according to claim 4, wherein the bag and the conduit of the liquid delivery assembly are in an anaerobic state.

7. The liquid delivery assembly according to claim 6, wherein said liquid is driven through said conduit towards said nozzle solely by way of a vacuum state of said bag.

8. The liquid delivery assembly according to claim 1, wherein said assembly includes one or more said modules operatively associated with each other and one or more said nozzles.

9. The liquid delivery assembly according to claim 8, wherein said one or more modules are connectable together.

10. The liquid delivery assembly according to claim 1, wherein said assembly includes a frother to froth said liquid prior to delivery to said nozzle.

11. A pressurized liquid delivery assembly comprising:

at least one liquid delivery module, each of the at least one liquid delivery module comprising:

a housing and an associated compartment, wherein the associated compartment is defined within a drawer, slidably locatable within the housing and moveable with respect to the housing to permit access by a user to the associated compartment;

a removable cartridge of the associated compartment defining a space that receives and holds a replaceable pressurized receptacle containing liquid to be dispensed by the pressurized liquid delivery assembly;

a liquid dispenser operatively associated with the replaceable pressurized receptacle and adapted to dispense liquid; and a conduit of the liquid dispenser, the conduit extendable from a dispensing nozzle to a liquid-receiving connector, the liquid receiving connector adapted to releasably connect to the replaceable pressurized receptacle in use.

12. The pressurized liquid delivery assembly according to claim 11, wherein the associated compartment in an open position provides access to the space to receive the replaceable pressurized receptacle.

13. The pressurized liquid delivery assembly according to claim 11, wherein the associated compartment in a closed position sealingly engages the associated compartment with the housing.

14. The pressurized liquid delivery assembly according to claim 11, wherein the replaceable pressurized receptacle is a pressurized liquid bag.

15. The pressurized liquid delivery assembly according to claim 11, wherein the liquid dispenser includes a handle extending from the dispensing nozzle.

16. The pressurized liquid delivery assembly according to claim 14, wherein the pressurized liquid bag and the conduit of the pressurized liquid delivery assembly are in an anaerobic state.

17. The pressurized liquid delivery assembly according to claim 16, wherein the liquid is driven through the conduit towards the dispensing nozzle solely by way of a vacuum state of the pressurized liquid bag.

18. The pressurized liquid delivery assembly according to claim 11, wherein the pressurized liquid delivery assembly includes the at least one liquid delivery module operatively associated with at least one dispensing nozzle, respectively.

19. The pressurized liquid delivery assembly according to claim 18, wherein the at least one liquid delivery module comprises at least two liquid-delivery modules, which are connectable together.

20. A pressurized liquid delivery assembly comprising:

at least one liquid delivery module, each of the at least one liquid delivery module comprising:

a housing and an associated compartment, wherein the associated compartment is within the housing and permits access by a user to the associated compartment;

a removable cartridge of the associated compartment defining a space that receives and holds a replaceable pressurized receptacle containing liquid to be dispensed by the pressurized liquid delivery assembly;

a liquid dispenser operatively associated with the replaceable pressurized receptacle and adapted to dispense liquid;

a conduit of the liquid dispenser, the conduit extendable from a dispensing nozzle to a liquid-receiving connector, the liquid receiving connector adapted to releasably connect to the replaceable pressurized receptacle in use; and a frother to froth said liquid prior to delivery to the dispensing nozzle.

* * * * *